US009384697B2

(12) United States Patent
Fujita et al.

(10) Patent No.: US 9,384,697 B2
(45) Date of Patent: Jul. 5, 2016

(54) ELECTRO-OPTICAL DEVICE AND ELECTRONIC APPARATUS

(71) Applicant: SEIKO EPSON CORPORATION, Tokyo (JP)

(72) Inventors: Shin Fujita, Suwa (JP); Kazuma Kitadani, Chino (JP)

(73) Assignee: SEIKO EPSON CORPORATION, Tokyo (JP)

( * ) Notice: Subject to any disclaimer, the term of this patent is extended or adjusted under 35 U.S.C. 154(b) by 440 days.

(21) Appl. No.: 13/748,108

(22) Filed: Jan. 23, 2013

(65) Prior Publication Data

US 2013/0215158 A1 Aug. 22, 2013

(30) Foreign Application Priority Data

Feb. 22, 2012 (JP) ..... 2012-036135

(51) Int. Cl.

| | |
|---|---|
| ***G09G 5/10*** | (2006.01) |
| ***G09G 3/30*** | (2006.01) |
| ***G09G 3/32*** | (2016.01) |

(52) U.S. Cl.

CPC ..... *G09G 3/3291* (2013.01); *G09G 3/3233* (2013.01); *G09G 2300/0861* (2013.01); *G09G 2310/0289* (2013.01); *G09G 2320/0285* (2013.01)

(58) Field of Classification Search

None

See application file for complete search history.

(56) References Cited

U.S. PATENT DOCUMENTS

| | | | | |
|---|---|---|---|---|
| 2003/0227262 | A1 | 12/2003 | Kwon | |
| 2004/0070557 | A1 | 4/2004 | Asano et al. | |
| 2005/0206590 | A1 | 9/2005 | Sasaki et al. | |
| 2005/0264492 | A1 * | 12/2005 | Knapp | G09G 3/3233 345/76 |
| 2007/0273619 | A1 | 11/2007 | Kitazawa et al. | |
| 2008/0303804 | A1 * | 12/2008 | Schmidt et al. | 345/204 |
| 2009/0251455 | A1 * | 10/2009 | Park et al. | 345/214 |
| 2010/0328365 | A1 | 12/2010 | Ikeda et al. | |
| 2011/0050741 | A1 * | 3/2011 | Jeong | 345/690 |
| 2013/0093653 | A1 * | 4/2013 | Ota et al. | 345/77 |

FOREIGN PATENT DOCUMENTS

| | | |
|---|---|---|
| CN | 101320543 A | 12/2008 |
| CN | 102005178 A | 4/2011 |
| JP | A-2003-271095 | 9/2003 |
| JP | A-2004-029791 | 1/2004 |
| JP | A-2004-133240 | 4/2004 |
| JP | A-2007-114426 | 5/2007 |
| JP | A-2007-316462 | 12/2007 |
| JP | A-2010-286541 | 12/2010 |
| JP | A-2011-013256 | 1/2011 |

* cited by examiner

*Primary Examiner* — Christopher R Lamb
(74) *Attorney, Agent, or Firm* — Oliff PLC

(57) ABSTRACT

An electro-optical device includes a display portion, a data line driving circuit, a first retention capacitor that retains the potential of the data line, a driving control circuit, and a display control circuit that supplies brightness information to the driving control circuit and also supplies an image signal to the data line driving circuit. The data line driving circuit includes a potential control line to which a potential control signal is supplied, a third retention capacitor one end of which is connected with the data line and the other one of which is supplied with a potential based on the image signal, and a first transistor that is electrically connected between the other end of the third retention capacitor and the potential control line. The driving control circuit controls the potential of the potential control signal based on the brightness information.

17 Claims, 23 Drawing Sheets

<(a) LIGHT EMISSION PERIOD>

<(b) INITIALIZATION PERIOD>

<(c) COMPENSATION PERIOD>

<(d) WRITE PERIOD>

AT END OF COMPENSATION PERIOD

WRITE PERIOD $$Vgate = \frac{Crf1}{(Crf1 + C0)}\{Vd(j) - Vref\} + Vp$$

$$= k1 * \{Vd(j) - Vref\} + Vp$$

$$\Delta Vg = k1 * \Delta V$$

<(a) LIGHT EMISSION PERIOD>

<(b) INITIALIZATION PERIOD>

<(c) COMPENSATION PERIOD>

<(d) WRITE PERIOD>

BEFORE START OF WRITE PERIOD

AFTER START OF WRITE PERIOD $$Vh = \frac{Crf2}{(C1+Crf2)} Vd(j) + \frac{C1}{(C1+Crf2)} Vref$$

$$\Delta Vh = \frac{Crf2}{(C1+Crf2)} \{Vd(j) - Vref\}$$

$$= k2*\{Vd(j) - Vref\}$$

ELECTRO-OPTICAL DEVICE AND ELECTRONIC APPARATUS

INCORPORATION BY REFERENCE

This application claims priority to Japanese Patent Application No. 2012-036135 filed on Feb. 22, 2012, in Japan, which is herein incorporated by reference in its entirety.

BACKGROUND

1. Technical Field

The present invention relates to electro-optical devices and electronic apparatuses.

2. Related Art

In recent years, various kinds of electro-optical devices using light emitting elements such as an organic light emitting diode (hereinafter referred to as "OLED") and the like have been proposed. Those electro-optical devices, in general, adopt a configuration in which pixel circuits including the above light emitting elements, transistors and so on are provided at positions corresponding to intersections of scanning lines and data lines so as to correspond to pixels of an image to be displayed (for example, see JP-A-2007-316462). In such configuration, when a potential data signal corresponding to a tone level of a pixel is applied to the gate of the transistor, the transistor supplies electric current according to voltage between the gate and the source of the transistor to a light emitting element, whereby the light emitting element emits light with luminance corresponding to the tone level.

Circuits for outputting data signals are required to have a high driving capability to charge the data lines in a short period of time. Meanwhile, in order to realize high quality in display, the circuits are required to control potential of data signals with high precision and express a fine change in tone. However, it has been difficult for a circuit having a high driving capability to control potential of data signals with high precision.

SUMMARY

An advantage of some aspects of the invention is to provide an electro-optical device capable of displaying a high-quality image with high-precision data signals being not needed.

An electro-optical device according to an aspect of the invention includes: a plurality of scanning lines; a plurality of data lines; a display portion equipped with a plurality of pixel circuits provided at positions corresponding to intersections of the plurality of scanning lines and the plurality of data lines; first retention capacitors which are provided corresponding to each of the plurality of data lines and retain potential of each of the data lines; a data line driving circuit electrically connected with the plurality of data lines; a driving control circuit that controls operation of the data line driving circuit; and a display control circuit for supplying brightness information, which indicates brightness of an entire screen to be displayed in the display portion, to the driving control circuit. In the electro-optical device, each of the plurality of pixel circuits includes: a light emitting element; a driving transistor that supplies an electric current to the light emitting element; a write transistor electrically connected between the gate of the driving transistor and the data line; and a second retention capacitor one end of which is electrically connected with the gate of the driving transistor to retain voltage between the gate and the source of the driving transistor. The display control circuit supplies an image signal that specifies luminance of the light emitting element to the data line driving circuit; the data line driving circuit includes a potential control line to which a potential control signal is supplied from the driving control circuit, and a plurality of level shift circuits provided corresponding to each of the plurality of data lines. Each of the plurality of level shift circuits includes: a third retention capacitor one end of which is connected with the data line and the other end of which is supplied with potential based on the image signal; and a first transistor electrically connected between the other end of the third retention capacitor and the potential control line. The driving control circuit controls potential of the potential control signal based on the brightness information.

According to this aspect of the invention, the data line is connected with the first retention capacitor and the one end of the third retention capacitor, while the other end of the third retention capacitor is supplied with potential based on the image signal that specifies luminance of the light emitting element. Therefore, the size of potential fluctuation of the data line takes a value obtained through compressing the size of potential fluctuation based on the image signal according to a capacitance ratio of the first retention capacitor and the third retention capacitor. In other words, the range of fluctuation in potential of the data line is made smaller than that of the fluctuation in potential based on the image signal. With this, it is possible to precisely set the potential of the gate node of the driving transistor without processing the data signal in a precisely fined manner, whereby electric current can be supplied to the light emitting element with precision so as to realize high quality in display. Since width of change in potential of the data line can be made smaller, crosstalk, unevenness or the like caused by potential fluctuation of the data line can be prevented from occurring.

In the case where the width of fluctuation in potential based on the image signal is compressed according to the capacitance ratio of the first retention capacitor and the third retention capacitor, luminance of the light emitting element is lowered in comparison with a case where the compression is not carried out. However, according to this aspect of the invention, controlling the potential of the potential control signal based on the brightness information makes it possible to cause the voltage between the gate and the source of the driving transistor to be larger, whereby a large electric current in size can be supplied to the light emitting element. In other words, according to this aspect of the invention, it is possible to carry out two operations simultaneously; that is, to control the size of electric current supplied to the light emitting element with precision and to supply a large electric current to the light emitting element. This makes it possible for the electro-optical device of the invention to display a high-quality image as well as display a bright image.

In the electro-optical device according to this aspect of the invention, a charge is supplied to the first retention capacitor and the second retention capacitor from the one end of the third retention capacitor via the data line so as to determine the potential of the gate node of the driving transistor. To be more specific, the potential of the gate node of the driving transistor is determined by a capacity value of the first retention capacitor, a capacity value of the second retention capacitor, and an amount of charge which is supplied by the third retention capacitor to the first and second retention capacitors. If the electro-optical device does not have the first retention capacitor, the potential of the gate node of the driving transistor is determined by the capacity value of the second retention capacitor and the amount of charge supplied by the third retention capacitor. Accordingly, in the case where the capacity value of the second retention capacitor relatively varies for each of the pixel circuits due to errors of the semiconductor manufacturing process, the gate node potential of the driving transistor also varies for each of the pixel circuits. In this case, unevenness in display occurs and display quality is lowered. In contrast, the invention includes the first retention capacitors that retain potential of the data line. Since the first retention capacitors are provided corresponding to each of the data lines, each of the first retention capacitors can be so configured as to have a larger area electrode than the second capacitor provided within the pixel circuit. Therefore, a relative variation in capacity value of each of the plurality of first retention capacitors provided in each column due to errors of the semiconductor manufacturing process, can be made smaller than that of the second retention capacitor. With this, variation in potential of the gate node of the driving transistor in each pixel circuit can be suppressed so as to display a high-quality image while preventing the occurrence of display unevenness.

In the electro-optical device according to the above aspect of the invention, it is preferable that the display control circuit include a storage unit in which luminance of the light emitting element, potential indicated by the image signal, and the brightness information are associated with each other and stored, and generate the image signal that specifies the luminance of the light emitting element based on the brightness information.

When brightness of an entire screen to be displayed in the display portion is changed through changing the potential of the potential control signal based on the brightness information, the relationship between the luminance of the light emitting element and the potential indicated by the image signal to be supplied to the light emitting element is also changed. In this case, if the gamma correction is carried out without considering the change in potential of the potential control signal, the light emitting element emits light with luminance that differs from the luminance specified by the image signal in some case.

On the other hand, the electro-optical device according to this aspect of the invention includes the storage unit that associates and stores luminance of the light emitting element, potential indicated by the image signal, and the brightness information as well. Accordingly, even if brightness of an entire screen to be displayed in the display portion is changed based on the brightness information, it is possible for the light emitting element to emit light with the correct luminance specified by the image signal.

In the electro-optical device according to the above aspect of the invention, it is preferable that the electro-optical device further include a scanning line driving circuit that controls operations of the plurality of pixel circuits, the data line driving circuit include a first power line that supplies an initial potential, the level shift circuit include a second transistor that is electrically connected between the one end of the third retention capacitor and the first power line, and that the driving control circuit keep the second transistor ON during a first period; during a second period which starts after the first period ends, the scanning line driving circuit keep the write transistor ON and the driving control circuit keep the first transistor ON while keeping the second transistor OFF; and during a third period which starts after the second period ends, the scanning line driving circuit keep the write transistor ON and the driving control circuit keep the first transistor and the second transistor OFF, and a potential based on the image signal be supplied to the other end of the third retention capacitor.

According to this aspect of the invention, upon initializing potential of the data line during the first and second periods, a potential signal that specifies luminance of the light emitting element is supplied to the other end of the third retention capacitor during the third period. Through this, the gate node potential of the driving transistor is accurately set to a value according to the potential signal that specifies the luminance of the light emitting element, thereby making it possible to display a high-quality image.

Further, during the third period, the potential based on the image signal supplied to the other end of the third retention capacitor is, after being compressed in accordance with the capacitance ratio of the third retention capacitor to the first retention capacitor, supplied to the gate node of the driving transistor. Therefore, the electro-optical device according to this aspect of the invention can precisely supply the light emitting element with an electric current in an appropriate size and display a high-quality image.

In the electro-optical device according to the above aspect of the invention, it is preferable that the level shift circuit include a fourth retention capacitor, and that one end of the fourth retention capacitor be provided with potential indicated by the image signal which is outputted by the display control circuit during at least a part of a period from the start of the first period to the start of the third period, and the one end thereof be electrically connected with the other end of the third retention capacitor.

According to this aspect of the invention, a data signal is supplied to the one end of the fourth retention capacitor during the first and second periods and retained temporarily therein, and thereafter supplied to the gate node of the driving transistor during the third period.

In a case where the electro-optic device does not have the fourth retention capacitor, because all operations to supply the data signal to the driving transistor are needed to be carried out during the third period, the third period is needed to be set sufficiently long.

In contrast, in this aspect of the invention, since operation of supplying the data signal and operation of initializing the data line and the like are carried out simultaneously during the first and second periods, a temporal restriction imposed upon operations to be carried out during a horizontal scanning period can be loosened. With this, it is possible to carry out the operation of supplying the data signal at lower speed and ensure a time period which is long enough for initializing the data lines and the like.

Further, according to this aspect of the invention, the size of fluctuation in potential based on the image signal is compressed using the fourth retention capacitor in addition to the first, second and third retention capacitors, and in turn, the electric current can be supplied to the light emitting element in a precisely fined manner.

In the electro-optical device according to the above aspect of the invention, it is preferable that the data line driving circuit include a plurality of pairs of a first switch and a second switch that are provided corresponding to each of the fourth retention capacitors; an output terminal of the first switch be electrically connected with the other end of the third retention capacitor; and an input terminal of the first switch be electrically connected with the one end of the fourth retention capacitor and an output terminal of the second switch, and that during a time period from the start of the first period to the start of the third period, the driving control circuit turn the second switch into an ON state while keeping the first switch OFF and the display control circuit supply the potential indicated by the image signal to an input terminal of the second switch; and during the third period, the driving control circuit turn the first switch into an ON state while keeping the second switch OFF.

In the electro-optical device according to the above aspect of the invention, it is preferable that the fourth retention capacitor include a plurality of fourth unit circuits that are electrically connected in parallel between a second power line supplied with a fixed potential and the output terminal of the second switch, each of the plurality of fourth unit circuits include a fourth unit capacitor and a fourth unit switch that are electrically connected in series between the second power line and the output terminal of the second switch, and the driving control circuit selectively turn part of or all of the plurality of fourth unit switches into an ON-state based on the brightness information.

According to this aspect of the invention, the capacity value of the fourth retention capacitor can be changed based on the brightness information. Through this, in the case where, for example, brightness of an entire screen to be displayed in the display portion is high and a possibility that display unevenness or the like is visually recognized due to the fluctuation in potential of the data line is low, it is possible to lower the compression rate with respect to the fluctuation width of potential based on the image signal and display a clear image in a larger contrast ratio.

In the electro-optical device according to the above aspects of the invention, it is preferable that the plurality of data lines be grouped for every predetermined number thereof, the input terminals of the predetermined number of the second switches corresponding to the predetermined number of data lines which belong to one group are connected in the form of common connection, and the driving control circuit turn the predetermined number of the second switches which belong to the above one group into an ON-state in a predetermined order in synchronization with the supplied image signal.

In the electro-optical device according to the above aspects of the invention, it is preferable for the pixel circuit to include a threshold compensation transistor that is electrically connected between the gate and the drain of the driving transistor, and for the scanning line driving circuit to keep the threshold compensation transistor ON during the second period and keep the threshold compensation transistor OFF during the periods other than the second period.

According to this aspect of the invention, since the potential of the gate of the driving transistor can be set to a value in accordance with a threshold voltage of the driving transistor, it is possible to compensate for the variation in threshold voltage for each of the driving transistors.

In the electro-optical device according to the above aspects of the invention, it is preferable that the electro-optical device further include a plurality of third power lines which are provided corresponding to each of the plurality of data lines and supply a predetermined reset potential, the pixel circuit include an initializing transistor electrically connected between the third power line and the light emitting element, and the scanning line driving circuit keep the initializing transistor ON during at least a part of the first through third periods.

According to this aspect of the invention, it is possible to suppress influence of the voltage retained by parasitic capacitance in the light emitting element.

In the electro-optical device according to the above aspect of the invention, it is preferable that each of the plurality of third power lines be provided along each of the plurality of data lines, and the first retention capacitor be formed by the data line and the third power line neighboring each other among the plurality of data lines and the plurality of third power lines.

According to this aspect of the invention, since the third retention capacitor can be made large enough in capacitance (that is, larger in capacitance than the first and second retention capacitors), the range of fluctuation in potential of the data line can be sufficiently reduced compared to the range of fluctuation in potential of the signal that specifies luminance of the light emitting element so that the potential of the gate node of the driving transistor can be precisely set without processing the data signal in a precisely fined manner. In addition, in the case where the third retention capacitor is made large enough in capacitance, the potential of the gate node of the driving transistor is prevented from varying for each of the pixel circuits, thereby making it possible to prevent the occurrence of display unevenness and to display a high-quality image. Note that the third retention capacitor may be formed by providing the data line and the second power line neighboring each other in the same layer. Further, the third retention capacitor may be formed by arranging the data line and the second power line neighboring each other so that they are overlapped each other when viewed from above.

In the electro-optical device according to the above aspects of the invention, it is preferable that the first retention capacitor include a plurality of first unit circuits that are electrically connected in parallel between the data line and the third power line neighboring each other of the plurality of data lines and the plurality of third power lines, each of the plurality of first unit circuits include a first unit capacitor and a first unit switch that are electrically connected in series between the data line and the third power line neighboring each other, and the driving control circuit selectively turn part of or all of the plurality of first unit switches into an ON state based on the brightness information.

In the electro-optical device according to the above aspects of the invention, it is preferable that the third retention capacitor include a plurality of third unit circuits that are electrically connected in parallel, each of the plurality of third unit circuits include a third unit capacitor and a third unit switch that are electrically connected in series with the data line, and the driving control circuit selectively turn part of or all of the plurality of third unit switches into an ON state based on the brightness information.

According to this aspect of the invention, for example, when brightness of an entire screen to be displayed in the display portion is high and a possibility that display unevenness or the like is visually recognized due to the fluctuation in potential of the data line is low, it is possible to lower the compression rate with respect to the fluctuation width of potential based on the image signal so as to display a clear image in a larger contrast ratio.

In the electro-optical device according to the above aspects of the invention, it is preferable for the pixel circuit to include a light emission control transistor electrically connected between the driving transistor and the light emitting element, and for the scanning line driving circuit to keep the light emission control transistor OFF during at least a time period from the start of the first period to the end of the third period.

The invention can be embodied in electro-optical devices, and can also be embodied in, in addition to those electro-optical devices, various kinds of electronic apparatuses including the electro-optical devices. Display systems such as a head-mounted display (HMD), an electronic view finder and so on can be cited as typical examples of the electronic apparatuses.

BRIEF DESCRIPTION OF THE DRAWINGS

The invention will be described with reference to the accompanying drawings, wherein like numbers reference like elements.

FIG. 25 is a perspective view of a head-mounted display (HMD) using the electro-optical device according to the embodiments of the invention or the like.

DESCRIPTION OF EXEMPLARY EMBODIMENTS

Hereinafter, embodiments in which the invention is embodied will be described with reference to the drawings.

First Embodiment

Figure 1:
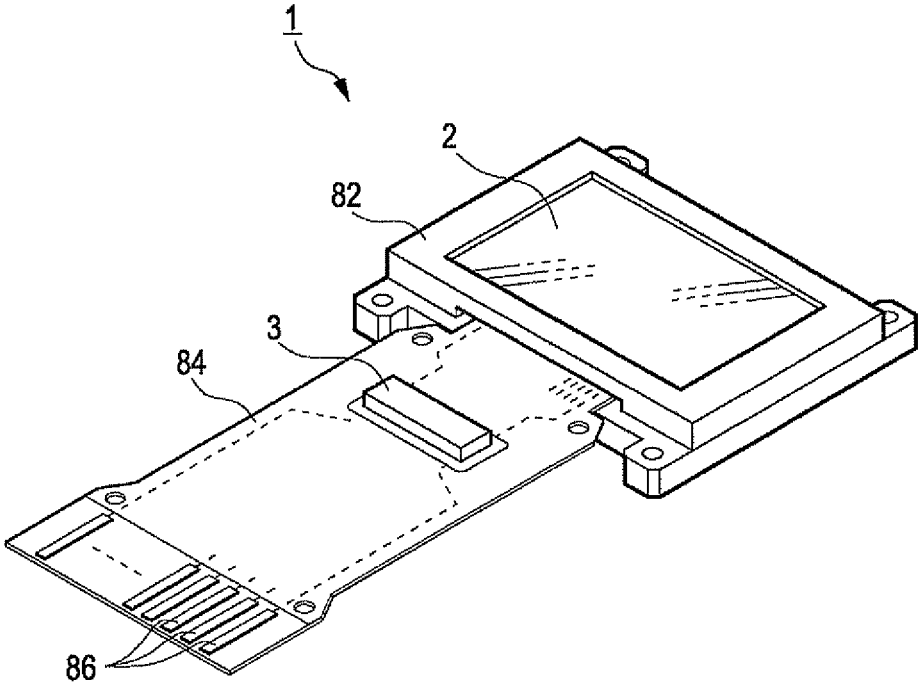
FIG. 1 is a perspective view illustrating the structure of an electro-optical device according to a first embodiment of the invention.

FIG. 1 is a perspective view illustrating the structure of an electro-optical device 1 according to a first embodiment of the invention. The electro-optical device 1 is a micro-display that displays an image in a head-mounted display, for example.

As shown in FIG. 1, the electro-optical device 1 includes a display panel 2 and a controller 3 that controls operations of the display panel 2. The display panel 2 includes a plurality of pixel circuits and a driving circuit that drives the pixel circuits. In this embodiment, the plurality of pixel circuits and the driving circuit included in the display panel 2 are formed on a silicon substrate, and an PLED as an example of a light emitting element is used in the pixel circuits. Further, the display panel 2 is housed in a frame-like case 82 which is opened in a display portion and connected with one end of an FPC (flexible printed circuits) substrate 84.

The controller 3 configured with a semiconductor chip is mounted on the FPC substrate 84 by a COF (chip on film) technique, and a plurality of terminals 86 are provided on the FPC substrate 84 to be connected with an upper-level circuit (not shown).

Figure 2:
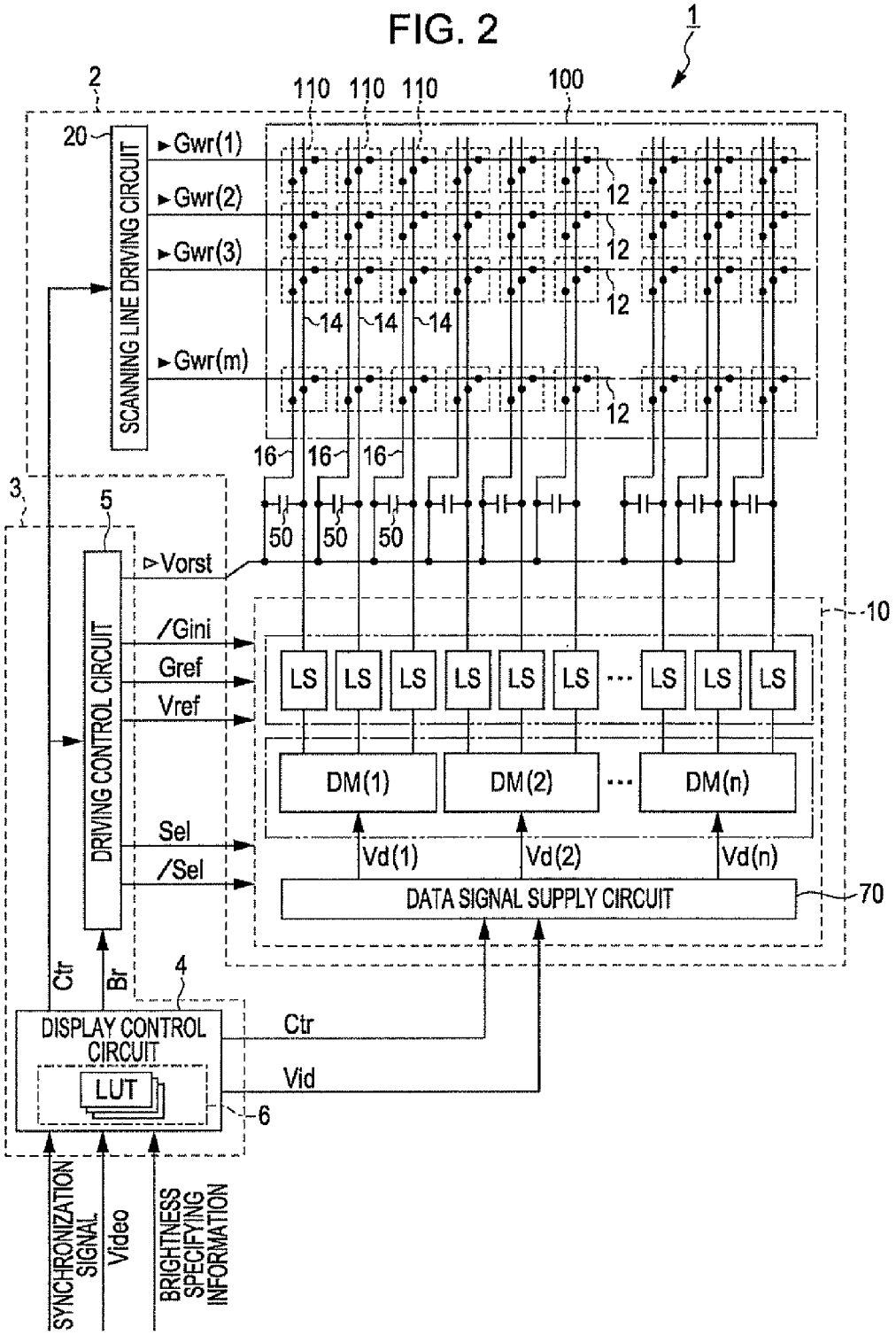
FIG. 2 is a diagram illustrating the configuration of the electro-optical device according to the first embodiment.

FIG. 2 is a block diagram illustrating the configuration of the electro-optical device 1 according to the first embodiment. As described above, the electro-optical device 1 includes the display panel 2 and the controller 3. The controller 3 includes a display control circuit 4 and a driving control circuit 5.

Digital image data Video is supplied to the display control circuit 4 in synchronization with a synchronization signal from the upper-level circuit (not shown). The image data Video is data that specifies a tone level of each pixel in an image to be displayed in the display panel 2 (more specifically, a display portion 100 which will be explained later) with 8 bits, for example. Moreover, the synchronization signal is a signal that includes a vertical synchronization signal, a horizontal synchronization signal, and a dot clock signal.

The display control circuit 4 generates a control signal Ctr based on the synchronization signal and supplies it to the display panel 2 and the driving control circuit 5. Note that the control signal Ctr is a signal that includes a pulse signal, a clock signal, an enable signal and the like.

The display control circuit 4 generates brightness information Br based on brightness specifying information inputted from an input unit (not shown) by a user of the electro-optical device 1, and supplies it to the driving control circuit 5. The brightness specifying information is data that specifies brightness of an entire screen when the display panel 2 (more specifically, the display portion 100 to be explained later) displays an image. Meanwhile, the brightness information Br is data that also specifies brightness of an entire screen when the display portion 100 displays an image, and can take different values from each other of a number of Rbr, where Rbr is a natural number equal to or greater than 1. Note that the brightness information Br may be set to a value equal to the brightness specifying information.

In this embodiment, the display control circuit 4 generates the brightness information Br based on the brightness specifying information inputted by a user. However, the brightness information Br may be generated based on the image data Video. For example, it may be calculated based on the average volume of luminance of light emitting elements specified by the image data Video.

Next, the display control circuit 4 generates an analog image signal Vid based on the brightness information Br and the image data Video in the following manner. That is, the display control circuit 4 has a storage unit 6 that associates and stores a potential indicated by the image signal Vid, luminance of a light emitting element (OLEO 130 which will be explained later) included in the display panel 2, and the brightness information Br. In the storage unit 6, look-up tables LUT of a number of Rbr are provided corresponding to each of the different values that can be taken by the brightness information Br. In each of the look-up tables LUT, the potential indicated by the image signal Vid and the luminance of the light emitting element of a case in which brightness of the screen to be displayed by the display portion 100 corresponds to a value indicated by the brightness information Br, are associated and stored. The display control circuit 4 outputs potential corresponding to the luminance specified by the image data Video and generates the image signal Vid through referring to the look-up table LUT that corresponds to the brightness information Br. Then, the display control circuit 4 supplies the generated image signal Vid to the display panel 2.

The driving control circuit 5 generates various kinds of control signals and potential based on the control signal Ctr and the brightness information Br that are supplied from the display control circuit 4, and supplies them to the display panel 2.

To be more specific, the driving control circuit 5 supplies the display panel 2 with control signals Sel (1), Sel (2) and Sel (3); control signals /Sel (1), /Sel (2) and /Sel (3), which are inverted logic signals of the control signals Sel (1), Sel (2) and Sel (3); a negative-logic control signal /Gini; a positive-logic control signal Gref; potential Vorst which is a predetermined reset potential; and a potential control signal Vref. Here, the potential Vref is determined based on the brightness information Br. Note that hereinafter, the control signals Sel (1), Sel (2) and Sel (3) are collectively called "control signal Sel", while the control signals /Sel (1), /Sel (2) and /Sel (3) are collectively called "control signal /Sel" in some case.

As shown in FIG. 2, the display panel 2 includes the display portion 100 and driving circuits (a data line driving circuit 10 and a scanning line driving circuit 20) for driving the display portion 100.

In the display portion 100, pixel circuits 110 corresponding to the pixels of an image to be displayed are arranged in matrix form. Specifically, in the display portion 100, m-row scanning lines 12 are provided each extending in a lateral direction (X direction) in the drawing, and 3n-column data lines 14, which are grouped every three columns, are provided each extending in a longitudinal direction (Y direction) in the drawing in a state where the scanning lines 12 and the data lines 14 are electrically insulated from each other. The pixel circuits 110 are provided at positions corresponding to intersections of the m-row scanning lines 12 and the 3n-column data lines 14. That is to say, the pixel circuits 110 are arranged in the form of an m-row×3n-column matrix in this embodiment.

Note that both m and n are a natural number. In order to individually specify the scanning lines 12 and the rows of the matrix of the pixel circuits 110, the rows are called as follows in some case; i.e., a 1st, 2nd, 3rd, . . . , (m−1)-th, and m-th row in the order from top to bottom in the drawings. Likewise, in order to individually specify the data lines 14 and the columns of the matrix of the pixel circuits 110, the columns are called as follows in some case; i.e., a 1st, 2nd, 3rd, . . . , (3n−1)-th, and (3n)-th column in the order from left to right in the drawings. Further, by using an integer j which is equal to or greater than 1 and equal to or less than n to give a general explanation about the grouping of the data lines 14, it can be stated that a (3j−2)-th column, (3j−1)-th column, and (3j)-th column data line 14 belong to a j-th group when counted from left.

The three pixel circuits 110 arranged at positions corresponding to intersections of the same single scanning line 12 and the 3-column data lines 14 which belong to the same group, correspond to red (R), green (G) and blue (B) pixels respectively, and represent one dot of a color image to be displayed with these three types of pixels. In other words, this embodiment is configured so that color of one dot is expressed in an additive color mixing manner using OLEDS that emit light corresponding to the RGB.

Further, in the display portion 100, as shown in FIG. 2, (3n)-column power lines 16 (third power lines) are provided extending in the longitudinal direction while being electrically insulated from each of the scanning lines 12. The potential Vorst for common use is supplied to each of the power lines 16. In order to individually specify the columns of the power lines 16, the power lines 16 are respectively called a 1st, 2nd, 3rd, . . . , (3n)-th, and (3n+1)-th column data line 16 in the order from left to right in the drawings in some case. Each of the 1st through (3n)-th column power lines 16 is provided along each of the first through (3n)-th data lines 14. In other words, when p is an integer which is equal to or greater than 1 and equal to or less than (3n), the p-th column power line 16 and the p-th column data line 14 are provided so as to neighbor to each other.

In the display panel 2, retention capacitors 50 of a number of (3n) are provided corresponding to each of the 1st through (3n)-th column data lines 14. One end of the retention capacitor 50 is connected with the data line 14, and the other end thereof is connected with the power line 16. That is, the retention capacitor 50 functions as the first retention capacitor that retains potential of the data line 14. It is advisable for the retention capacitor 50 to be formed by making the power line 16 and the data line 14 neighboring each other sandwich an insulating material (dielectric material) therebetween. In this case, the distance between the power line 16 and the data line 14 neighboring each other is so determined as to obtain a necessary amount of capacitance. Hereinafter, the capacity value of the retention capacitor 50 is referred to as Cdt.

In FIG. 2, the retention capacitors 50 are provided outside of the display portion 100; however, it is to be noted that FIG. 2 is an equivalent circuit of the device and the retention capacitors 50 may be provided inside of the display portion 100. In addition, the retention capacitors 50 may be provided at locations across from the inside to the outside of the display portion 100.

The scanning line driving circuit 20 generates scanning signals Gwr used for scanning the scanning lines 12 one by one row during a frame period according to the control signal Ctr. Note that the scanning signals Gwr each provided to the 1st, 2nd, 3rd, . . . , (m−1)-th, or (m)-th row scanning line 12 are respectively referred to as Gwr (1), Gwr (2), Gwr (3), Gwr (m−1), and Gwr (m).

The scanning line driving circuit 20 supplies, in addition to the scanning signals Gwr (1) through Gwr (m), generates various kinds of control signals for each of the rows in synchronization with the scanning signals Gwr and supplies them to the display portion 100; however, those control signals are not shown in FIG. 2. Note that the frame period is a period of time which is necessary for the electro-optical device 1 to display one cut's (frame's) worth of images. For example, if the frequency of a vertical synchronization signal included in the synchronization signal is 120 Hz, the frame period is 8.3 milliseconds, which corresponds to one cycle of the frequency.

The data line driving circuit 10 includes level shift circuits LS of a number of (3n) each provided corresponding to each of the (3n)-column data lines 14, demultiplexers DM of the number of (3n) that are provided every 3-column data lines 14 configuring each group, and a data signal supply circuit 70.

The data signal supply circuit 70 generates data signals Vd (1), Vd (2), . . . Vd (n) based on the image signal Vid and the control signal Ctr supplied from the controller 3. To be more specific, the data signal supply circuit 70 includes, for example, shift registers in its configuration, and caries out time-division processing on the image signal Vid so as to generate the data signals Vd (1), Vd (2), . . . Vd (n). Subsequently, the data signal supply circuit 70 supplies the data signals Vd (1), Vd (2), . . . Vd (n) to the respective demultiplexers DM each of which corresponds to the 1st, 2nd, . . . , or n-th group. Note that a maximum value of potential that the data signals Vd (1), Vd (2), . . . Vd (n) can take is referred to as Vmax, while a minimum value thereof is referred to as Vmin.

Figure 3:
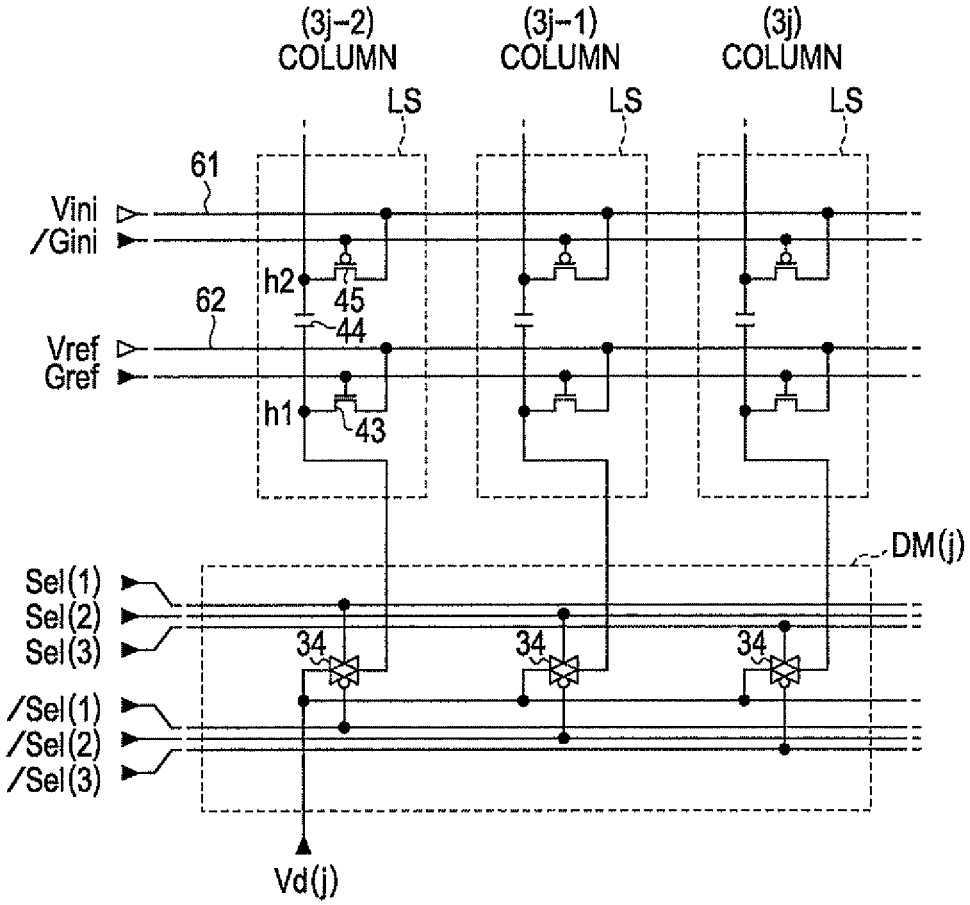
FIG. 3 is a diagram illustrating a driving control circuit of the electro-optical device according to the first embodiment.

FIG. 3 is a circuit diagram for explaining configurations of the demultiplexers DM and the level shift circuits LS. In FIG. 3, the demultiplexer DM which belongs to the j-th group and the three level shift circuits LS connected to this demultiplexer DM are illustrated as being typical of the configurations. Hereinafter, the multiplexer DM that belongs to the j-th group is referred to as DM (j) in some case.

The configurations of the demultiplexer DM and the level shift circuit LS will be described below with reference to FIG. 3 in addition to FIG. 2.

As shown in FIG. 3, the demultiplexer DM is a collective entity of transmission gates 34 (second switches) provided for each of the columns, in which the data signal is supplied in series to the three columns configuring each group. Input terminals of the transmission gates 34 corresponding to the (3j−2), (3j−1) and (3j)-th columns that belong to the j-th group, are connected with each other at a terminal for common use; and each data signal vd (j) is supplied to the terminal for common use. The transmission gate 34 arranged on the (3j−2)-th column which is the leftmost column within the j-th group, is turned ON (conductive) when the control signal Sel (1) is at H-level (the control signal /Sel (1) is at L-level). Likewise, the transmission gate 34 arranged on the (3j−1)-th column which is the central column within the j-th group, is turned ON when the control signal Sel (2) is at H-level (the control signal /Sel (2) is at L-level), while the transmission gate 34 arranged on the (3j)-th column which is the rightmost column within the j-th group, is turned ON when the control signal Sel (3) is at H-level (the control signal /Sel (3) is at L-level).

The level shift circuit LS includes a set of a retention capacitor 44, an N-channel MOS transistor 43 (first transistor) and a P-channel MOS transistor 45 (second transistor) on each of the columns, and shifts the potential of the data signal outputted from an output terminal of the transmission gate 34 of each column. One end of the retention capacitor 44 is connected with the corresponding data line 14 and the drain node of the transistor 45, meanwhile the other end of the retention capacitor 44 is connected with the output terminal of the transmission gate 34 and the drain node of the transistor 43. In other words, the retention capacitor 44 functions as the third retention capacitor with the one end being connected with the data line 14. Although not shown in FIG. 3, the capacity value of the retention capacitor 44 is referred to as Crf1.

The source node of the transistor 45 of each column is connected with a power line 61 (first power line) for common use across all the columns, and the driving signal /Gini for common use is supplied to the gate nodes thereof from the driving control circuit 5 across all the columns. With this, the transistor 45 electrically connects a node h2 as the one end of the retention capacitor 44 (as well as the data line 14) with the power line 61 when the control signal /Gini is at L-level, and electrically disconnects them when the control signal /Gini is at H-level. The potential Vini (initial potential) is supplied to the power line 61 from the driving control circuit 5.

The source node of the transistor 43 of each column is connected with a power line 62 (potential control line) for common use across all the columns, and the driving signal Gref for common use is provided to the gate nodes thereof from the driving control circuit 5 across all the columns. With this, the transistor 43 electrically connects a node h1 as the other end of the retention capacitor 44 with the power line 62 when the control signal Gref is at H-level, and electrically disconnects them when the control signal Gref is at L-level. The potential Vref (potential control signal) is supplied to the power line 62 from the driving control circuit 5.

The pixel circuits 110 will be described below with reference to FIG. 4. Since the pixel circuits 110 have the same configuration when viewed from an electrical standpoint, the description is made exemplifying the pixel circuit 110 in the i-th row and the (3j−2)-th column, which is the leftmost entry within the j-th group on the i-th row. Note that "i" is a symbol used for indicating the rows in the array of the pixel circuits 110 in a general form and is an integer which is equal to or greater than 1 and equal to or less than m.

Figure 4:
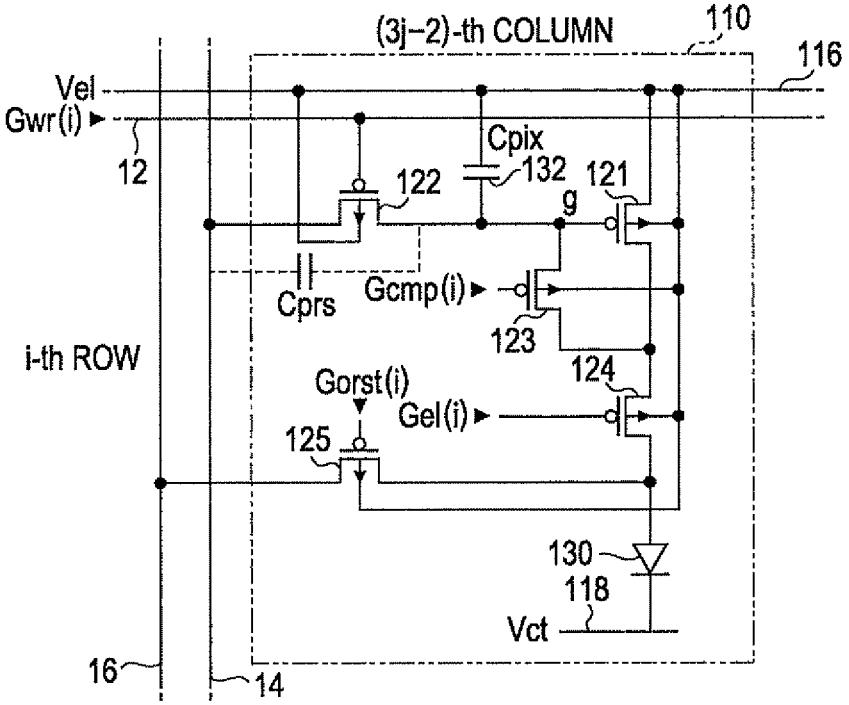
FIG. 4 is a diagram illustrating a pixel circuit of the electro-optical device according to the first embodiment.

As shown in FIG. 4, the pixel circuit 110 includes P-channel MOS transistors 121 through 125, the OLEO 130, and a retention capacitor 132. To the pixel circuit 110, the scanning signal Gwr (i) and control signals Gel (i), Gcmp (i), Gorst (i) are supplied. The scanning signal Gwr (i) and the control signals Gel (i), Gcmp (i), Gorst (i) are respectively supplied corresponding to the i-th row by the scanning driving circuit 20. Accordingly, the scanning signal Gwr (i) and the control signals Gel (i), Gcmp (i), Gorst (i) are supplied for common use to the pixel circuits of other columns than the (3j−2)-th column being mentioned as long as the circuits are on the i-th row.

Of the transistor 122, the gate node is connected with the scanning line 12 of the i-th row, one of the drain and source nodes is connected with the data line 14 of the (3j−2)-th column, and the other one thereof is connected with the gate node g of the transistor 121, one end of the retention capacitor 132 and one of the source and drain nodes of the transistor 123. In other words, the transistor 122 is electrically connected between the gate node g of the transistor 121 and the data line 14, and functions as the write transistor that controls electrical connection between the gate node g of the transistor 121 and the data line 14. It is to be noted that the gate node of the transistor 121 is referred to as "gate node g" so as to distinguish it from other nodes.

Of the transistor 121, the source node is connected with the power line 116, and the drain node is connected with the other one of the source and drain nodes of the transistor 123, and the source node of the transistor 124. Potential Vel as a high-level side potential of the power source in the pixel circuit 110 is supplied to the power line 116.

It has been discussed that, in the transistors 121 and 122, the drain node or the source node is electrically connected with other constituent elements. However, it is possible that the node having been described as the drain node becomes the source node, and the node having been described as the source node becomes the drain node if a potential condition is changed in the circuit. The situation is the same in the transistors 123 through 125 described below. In either case, for example, one of the source node and the drain node of the transistor 121 is electrically connected with the power line 16, and the other one thereof is electrically connected with the OLED 130 via the transistor 124. Further in FIG. 4, the other one of the source node and the drain node of the transistor 121 is electrically connected with the anode of the OLED 130 via the transistor 123. In the case where the transistor 121 is driven in its saturation region, a conduction state of the transistor 121 in proportion to voltage between the gate and the source of the transistor 121 is controlled, and the electric current in accordance with the conduction state is supplied into the OLED 130. In other words, the transistor 121 functions as the driving transistor which causes an electric current to flow in a quantity proportional to the voltage between the gate node and the source node of the transistor 121.

The control signal Gcmp (i) is supplied to the gate node of the transistor 123. The transistor 123 functions as the threshold compensation transistor which controls electrical connection between the source node and the gate node g of the transistor 121.

The control signal Gel (i) is supplied to the gate node of the transistor 124, and the drain node thereof is connected with the source node of the transistor 125 and the anode of the OLED 130. That is to say, the transistor 124 functions as the light emission control transistor which controls electrical connection between the drain node of the transistor 121 and the anode of the OLED 130.

The control signal Gorst (i) corresponding to the i-th row is supplied to the gate node of the transistor 125, and the drain node thereof is connected with the (3j−1)-th column power line 16 and held at the potential Vorst. The transistor 125 functions as the initializing transistor which controls electrical connection between the power line 16 and the anode of the OLED 130.

In this embodiment, since the display panel 2 is formed on a silicon substrate, the potential Vel is a substrate potential of the transistors 121 through 125.

The one end of the retention capacitor 132 is connected with the gate node g of the transistor 121 and the other end thereof is connected with the power line 116. With this, the retention capacitor 132 functions as the second retention capacitor which retains the voltage between the gate and source nodes of the transistor 121. The capacity value of the retention capacitor 132 is referred to as Cpix. In this case, the capacity value Cdt of the retention capacitor 50, the capacity value Crf1 of the retention capacitor 44 and the capacity value Cpix of the retention capacitor 132 are determined so that a relation of Cdt>Crf1>>Cpix holds. To rephrase, they are determined so that Cdt is greater than Crf1 and Cpix is sufficiently smaller than Cdt and Crf1. As the retention capacitor 132, parasitic capacitance in the gate node g of the transistor 121 may be used, or capacitance which is formed by sandwiching an insulating layer between different conductive layers from each other in the silicon substrate may be used.

The anode of the OLED 130 is a pixel electrode individually provided for each of the pixel circuits 110. Meanwhile, the cathode of the OLED 130 is a common electrode 118 for common use to all the pixel circuits 110, and is held at potential Vct as a low-level side potential of the power source in the pixel circuit 110. The OLED 130 is an element in which a white organic EL layer is sandwiched between the anode and the cathode having light transmission characteristics in the silicon substrate mentioned above. At the output side (cathode side) of the OLED 130, color filters each of which corresponds to one of the RGB colors are overlapped.

In the OLED 130 as described above, when an electric current flows from the anode to the cathode, holes injected from the anode and electrons injected from the cathode are recombined in the organic EL layer so as to create excitons; as a result, white light is generated. The generated white light passes through the cathode, which is on the opposite side to the anode, experiences coloring by the color filters, and is visually recognized by an observer.

Operations of First Embodiment

Figure 5:
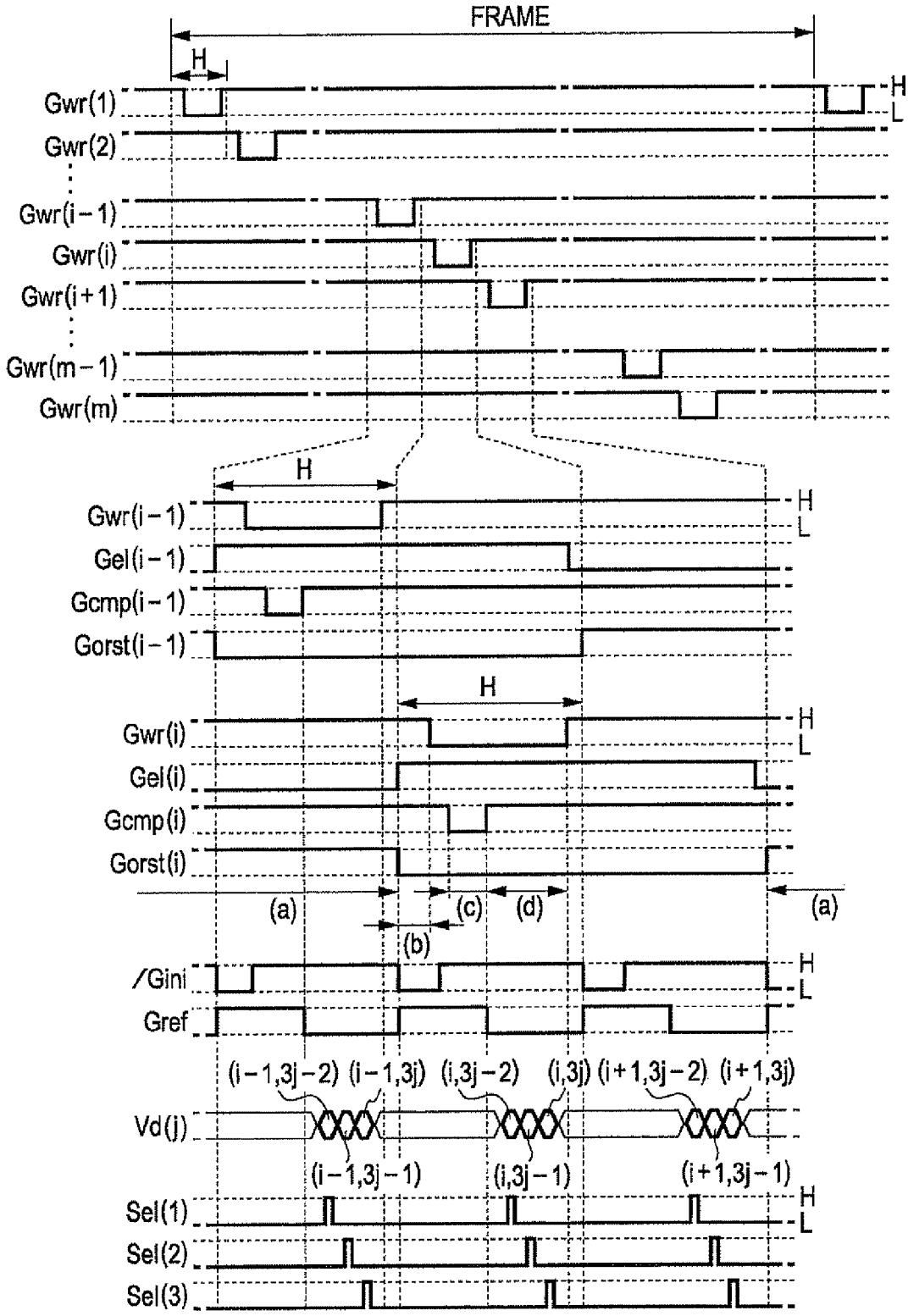
FIG. 5 is a timing chart illustrating operation of the electro-optical device according to the first embodiment.

Operations of the electro-optical device 1 will be described with reference to FIG. 5. FIG. 5 is a timing chart for explaining operations of each constituent portion of the electro-optical device 1. As shown in FIG. 5, the scanning line driving circuit 20 switches the scanning signals Gwr (1) through Gwr (m) to L-level one after the other, and scans the scanning lines 12 of the 1st row through the m-th row during each one-horizontal scanning period (H) in series during a one-frame period. Operation in the one-horizontal scanning period (H) is common to the pixel circuits 110 across all the rows. Therefore, operation of the pixel circuit 110 specifically in the i-th row and the (3j−2)-th column during a scanning period in which horizontal scanning is carried out on the i-th row, is cited and described in detail below.

In this embodiment, roughly speaking, the scanning period of the i-th row is divided into an initialization period indicated by (b) in FIG. 5, a compensation period indicated by (c), and a write period indicated by (d). After the write period of (d), a light emission period indicated by (a) appears and the i-th row scanning period is started again after the one-frame period having passed. Accordingly, a cycle of a light emission period, an initialization period, a compensation period, a write period, and a light emission period in time sequence is repeated. Note that in FIG. 5, the scanning signal Gwr (i−1) and the control signals Gel (i−1), Gcmp (i−1), Gorst (i−1) corresponding to the (i−1)-th row respectively have preceding waveforms by one-horizontal scanning period (H) in time sequence compared to those of the scanning signal Gwr (i) and the control signals Gel (i), Gcmp (i), Gorst (i) corresponding to the (i)-th row. Here, the (i−1)-th row is ahead of the i-th row by one row.

Light Emission Period

Figure 6:
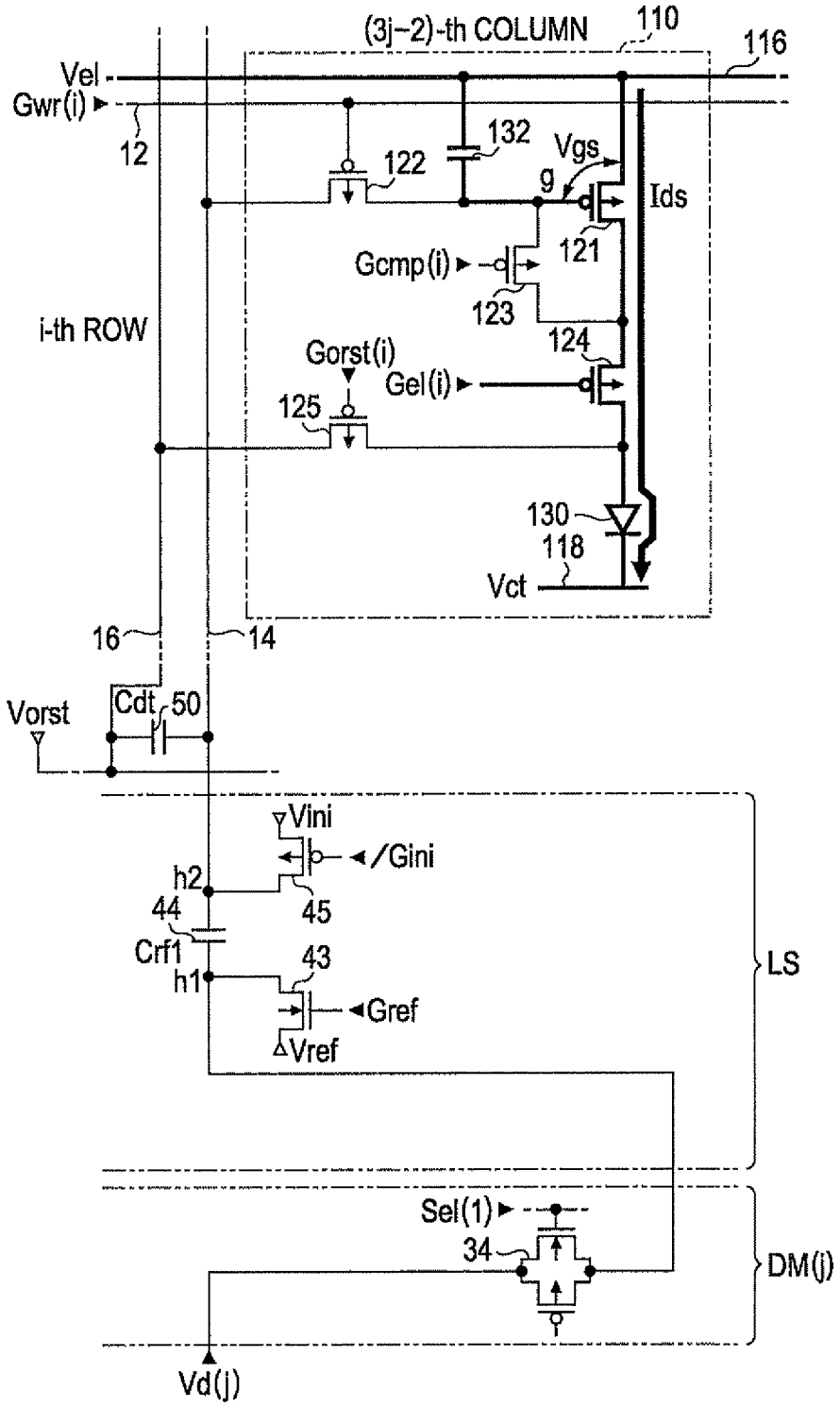
FIG. 6 is a diagram for explaining operation of the electro-optical device according to the first embodiment.

For the sake of convenience in explanation, the light emission period as a preceding stage of the initialization period is described first. As shown in FIG. 5, in the light emission period of the i-th row, the scanning line driving circuit 20 sets the scanning signal Gwr (i) to H-level, the control signal Gel (i) to L-level, the control signal Gcmp(i) to H-level, and the control signal Gorst (i) to H-level, respectively. Accordingly, as shown in FIG. 6, in the pixel circuit 110 in the i-th row and the (3j−2)-th column, the transistor 124 is turned ON, and the transistors 122, 123 and 125 are turned OFF. Therefore, the transistor 121 supplies an electric current Ids in proportion to voltage Vgs between the gate and source nodes thereof to the OLED 130. In this embodiment, as will be described later, the voltage Vgs in the light emission period is a value shifted from the threshold voltage of the transistor 121 based on the potential of the data signal through level-shift processing. Accordingly, the electric current in accordance with the tone level flows in the OLED 130 while compensating the threshold voltage of the transistor 121.

Since the light emission period of the i-th row is a time period during which the horizontal scanning is carried out on the rows other than the i-th one, the potential of the data line 14 varies arbitrarily. However, because the transistor 122 is in an OFF-state in the pixel circuit 110 of the i-th row, the potential variation of the data line 14 is not cared in this case. Note that in FIG. 6, an important path in the explanation of operation of the circuit is illustrated with a bold line (similar to FIGS. 7 through 9 and FIGS. 16 through 18 described later).

Initialization Period

Figure 7:
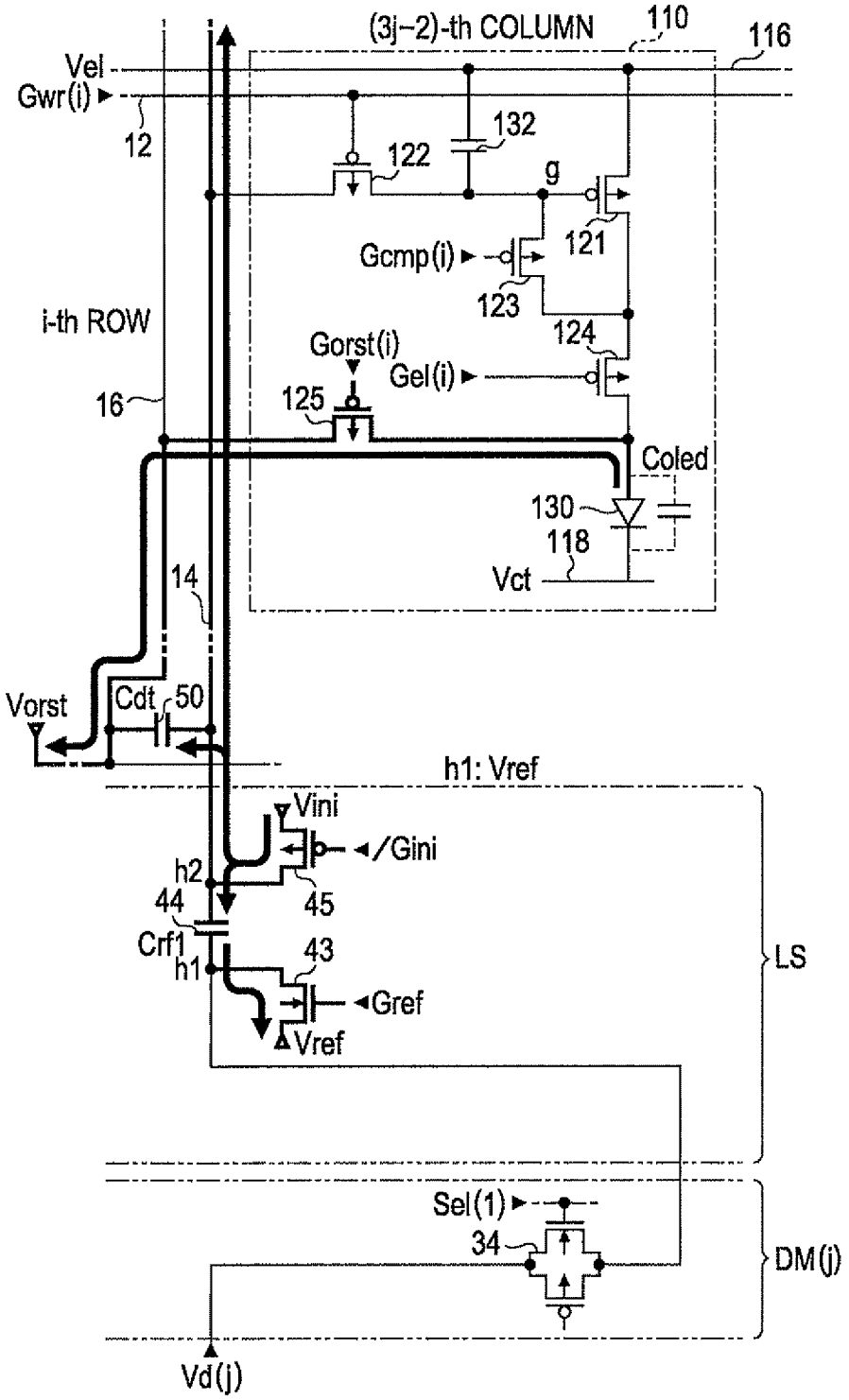
FIG. 7 is a diagram for explaining operation of the electro-optical device according to the first embodiment.

Next, at the beginning of the i-th row scanning period, the initialization period of (b) as the first period is started first. As shown in FIG. 5, during the initialization period, the scanning line driving circuit 20 sets the scanning signal Gwr (i) to H-level, the control signal Gel (i) to H-level, the control signal Gcmp(i) to H-level, and the control signal Gorst (i) to L-level, respectively. Accordingly, as shown in FIG. 7, in the pixel circuit 110 in the i-th row and the (3j−2)-th column, the transistor 124 is turned OFF and the transistors 125 is turned ON. Therefore, the path of the electric current supplied to the PLED 130 is blocked and the anode of the OLED 130 is reset to the potential Vorst. Since the OLED 130 is, as described before, an element in which an organic EL layer is sandwiched by the anode and the cathode, a parasitical capacitor Coled illustrated with a broken line in the drawing is present in parallel between the anode and the cathode. While electric current is flowing in the OLED 130 during the light emission period, the voltage between the anode and cathode terminals of the OLED 130 is retained by the capacitor Coled. However, this retained voltage is reset when the transistor 125 is turned ON. Therefore, in this embodiment, it is unlikely to be influenced by the voltage retained by the capacitor Coled when the electric current flows again in the subsequent light emission period.

To be more specific, for example, in the case where the voltage is not reset when luminance of an image to be displayed is changed from high to low, a high voltage at the time when the luminance of the image has been high (a large electric current has flown) is retained so that an excessive amount of electric current flows even if a small electric current is required for the subsequent display; as a result, the next image cannot be appropriately displayed at low luminance. In contrast, in this embodiment, because the anode potential of the OLED 130 is reset by the transistor 125 being turned ON, the capability of displaying an image at lower luminance can be enhanced. In this embodiment, the potential Vorst is set to a value so that a difference between the potential Vorst and the potential Vet of the common electrode 118 is smaller than the light emission threshold voltage of the OLED 130. Therefore, the OLED 130 is in an OFF-state (non-light emission) during the initialization period (also during the compensation and write periods to be explained next).

Meanwhile, as shown in FIG. 5, the driving control circuit 5 sets the control signal /Gini to L-level and the control signal Gref to H-level, respectively in the initialization period. Accordingly, as shown in FIG. 7, the transistors 43 and 45 are turned ON in the level shift circuit LS. Through this, the one end of the retention capacitor 44 and the power line 61 are electrically connected with each other, and the node h2 electrically connected with the one end of the retention capacitor 44 and the data line 14 are initialized and set to the potential Vini further, the other end of the retention capacitor 44 and the power line 62 are electrically connected with each other, and the node h1 electrically connected with the other end of the retention capacitor 44 is initialized and set to the potential Vref.

In this embodiment, the potential Vini is set to a value so that the value (Vel−Vini) is greater than the threshold voltage |Vth| of the transistor 121. Note that the threshold voltage with takes a negative value when measured with the potential of the source node being a reference potential because the transistor 121 is a P-channel type transistor. Hereinafter, in order to avoid causing confusion when explaining a threshold voltage, that is, whether it is higher or lower, the threshold voltage will be expressed in an absolute value in the form of |Vth| so that the threshold voltage is specified by the quantity thereof.

Compensation Period

Figure 8:
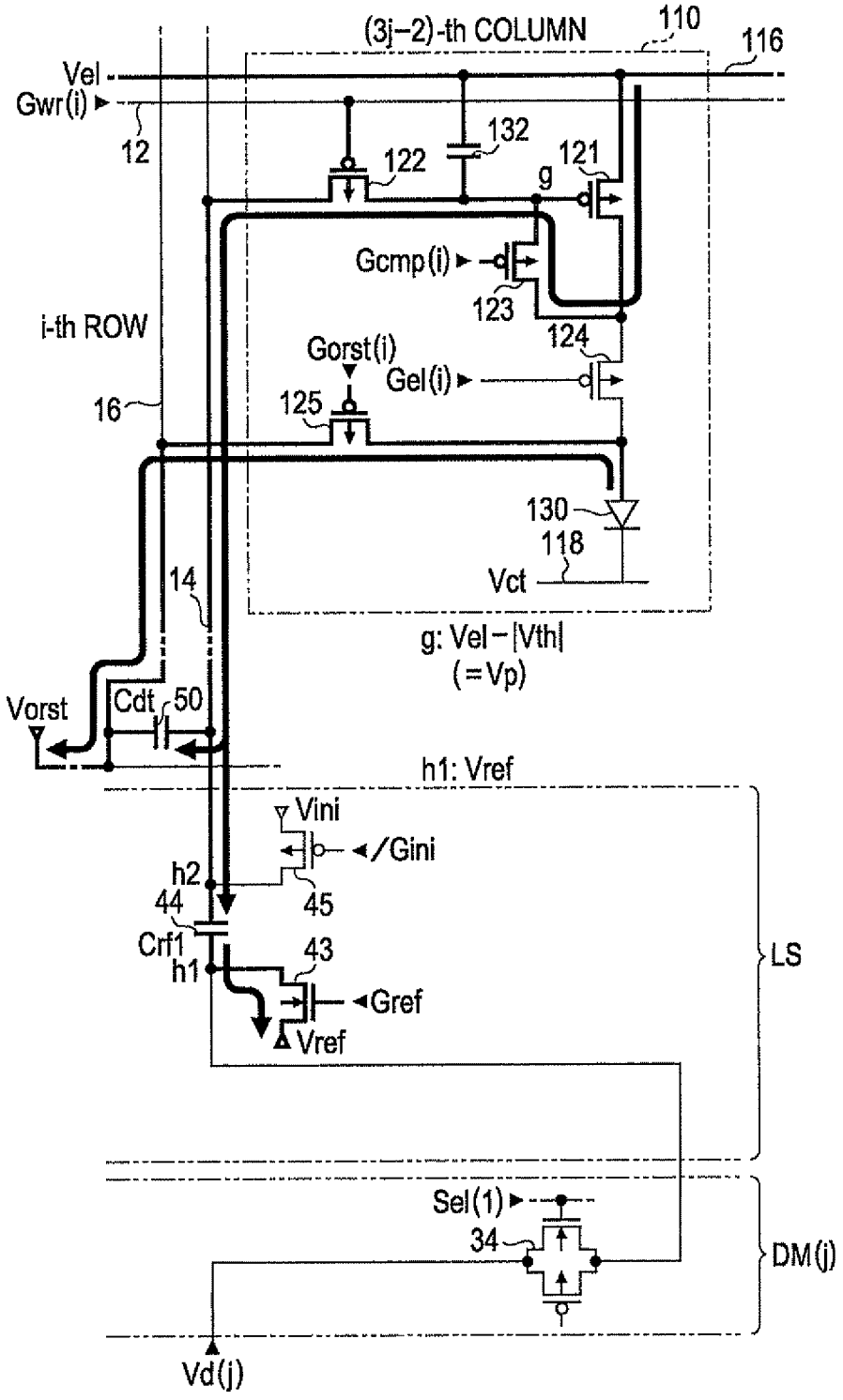
FIG. 8 is a diagram for explaining operation of the electro-optical device according to the first embodiment.

In the i-th row scanning period, the compensation period of (c) as the second period is started next. In the compensation period, as shown in FIG. 5, the driving control circuit 5 sets the control signals /Gini and Gref to H-level. Accordingly, as shown in FIG. 8, the transistor 43 is turned ON, and the transistor 45 is turned OFF in the level shift circuit LS. With this, the other end of the retention capacitor 44 and the power line 62 are electrically connected, and the node h1 is set to the potential Vref.

Further, in the compensation period, as shown in FIG. 5, the scanning line driving circuit 20 sets the scanning signal Gwr (i) to L-level, the control signal Gel (i) to H-level, the control signal Gcmp(i) to L-level, and the control signal Gorst (i) to L-level, respectively. Accordingly, as shown in FIG. 8, since the transistor 123 is turned ON, the transistors 121 becomes a diode-connected transistor. With this, a drain current flows in the transistor 121 so as to charge the gate node g and the data line 14. To be more specific, the electric current flows in a path from the power line 116, passing through the transistors 121, 123 and 122, to the data line 14 of the (3j−2)-th column. Accordingly, potential of the data line 14 and the gate node g, which are connected with each other due to the transistor 121 being turned ON, is raised from the potential Vini. However, because the electric current that flows in the path mentioned above becomes unlikely to flow as the potential of the gate node g comes closer to the potential (Vel−|Vth|), the data line 14 and the gate node g are saturated at the potential (Vel−|Vth|) until the compensation period is ended. Accordingly, the retention transistor 121 until the compensation period is ended. Note that hereinafter, the potential (Vel−|Vth|) of the gate node g at the time when the compensation period is ended is referred to as potential Vp in some case.

Write Period

After the compensation period, the write period of (d) as the third period is started. During the write period, as shown in FIG. 5, the scanning line driving circuit 20 sets the scanning signal Gwr (i) to L-level, the control signal Gel (i) to H-level, the control signal Gcmp(i) to H-level, and the control signal Gorst (i) to L-level, respectively. With this, the transistor 121 is released from its diode-connected state. Further, as shown in FIG. 5, the driving control circuit 5 sets the control signal /Gini to H-level and the control signal Gref to L-level, respectively. Through this, the transistor 45 is kept in the OFF-state and the transistor 43 is turned OFF. Accordingly, a path from the data line 14 of the (3j−2)-th column to the gate node g of the pixel circuit 110 in the i-th row and the (3j−2)-th column is caused to be in a floating state. However, the potential of the path is retained by the retention capacitors 50 and 132 at (Vel−|Vth|), i.e., the potential Vp.

During the i-th row write period, with regard to the j-th group, the data signal supply circuit 70 switches the data signal Vd (j) to a potential corresponding to the tone level of a pixel in the i-th row and the (3j−2)-th column, the tone level of a pixel in the i-th row and the (3j−1)-th column and the tone level of a pixel in the i-th row and the (3j)-th column, in series. Meanwhile, in synchronization with the switching of the data signal potential, the driving control circuit 5 exclusively sets the control signals Sel (1), Sel (2) and Sel (3) to H-level in series. Although not shown in FIG. 5, the driving control circuit 5 also outputs the control signals /Sel (1), /Sel (2) and /Sel (3), which are inverted logic signals of the control signals Sel (1), Sel (2) and Sel (3). Through this, in the demultiplexers DM, the transmission gates 34 in each group are turned ON in series in the order from the leftmost column to the central column, and the rightmost column.

Figure 9:
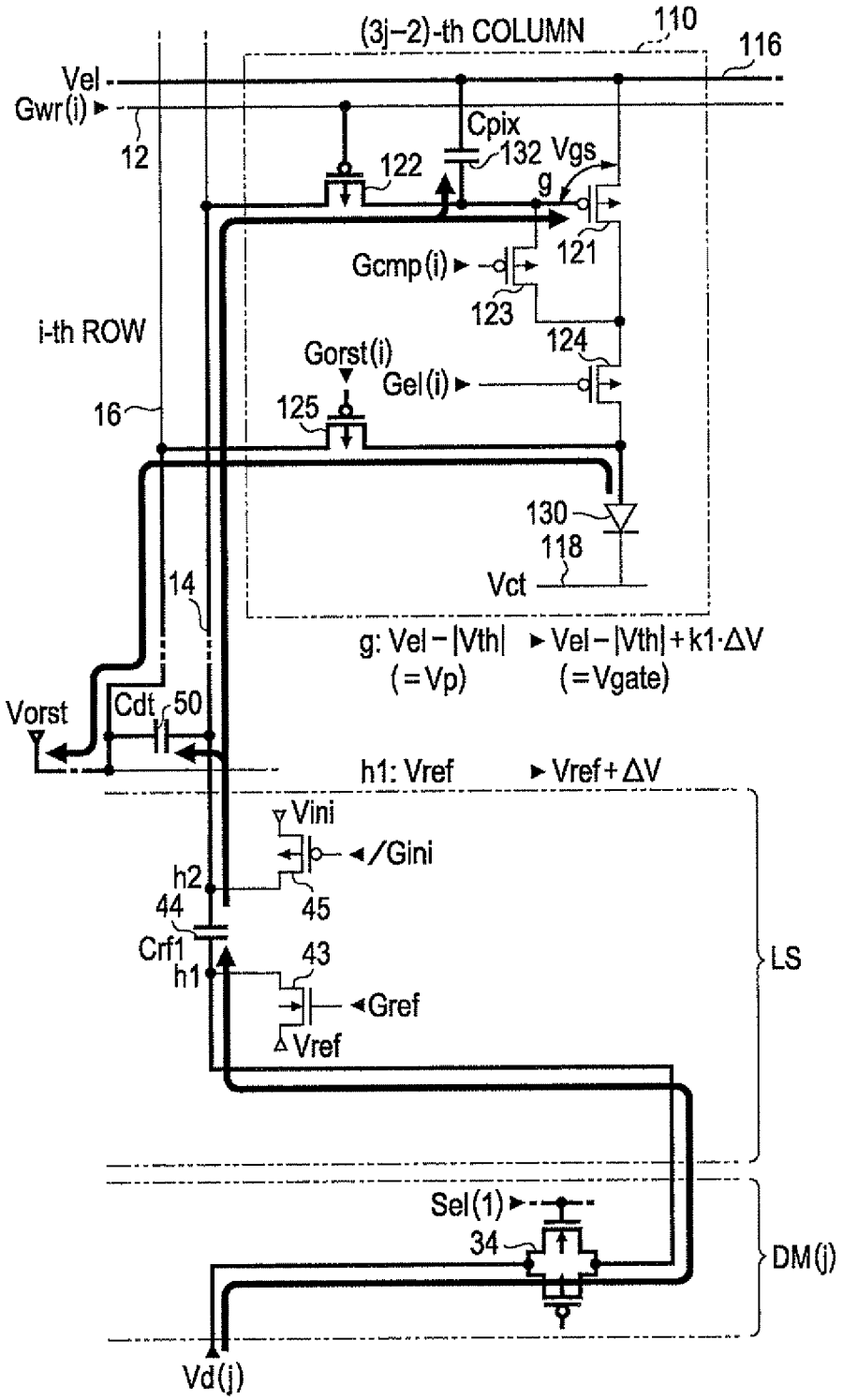
FIG. 9 is a diagram for explaining operation of the electro-optical device according to the first embodiment.

As shown in FIG. 9, when the transmission gate 34 of the leftmost column is turned ON by the control signals Sel (1) and /Sel (1), the node h1 as the other end of the retention capacitor 44 is changed from the potential Vref having been set in the compensation period to the potential of data signal Vd (j), i.e., the potential that corresponds to the tone level of the pixel in the i-th row and the (3j−2)-th column.

Figures 10A, 10B:
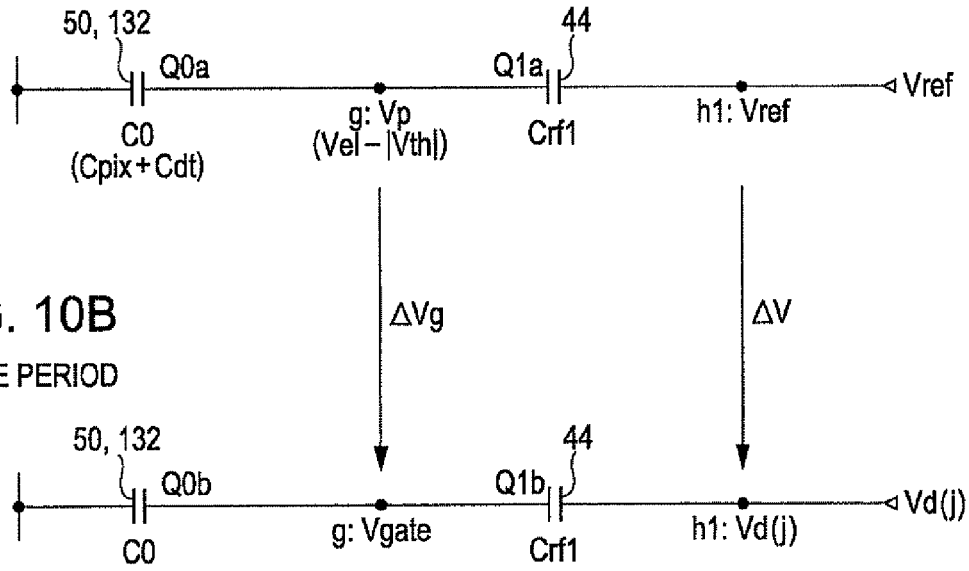
FIGS. 10A and 10B are diagrams for explaining change in potential of a gate node in the electro-optical device according to the first embodiment of the invention.

The change in potential of the gate node g at this time will be described below with reference to FIGS. 10A and 10B. FIGS. 10A and 10B are diagrams for explaining the change in potential of the gate node g and the node h1 during the compensation period and the write period. FIG. 10A indicates the potential of the gate node g and the node h1 when the compensation period is ended (to be more precise, a time period from the time when the compensation period is ended to the time when the data signal Vd (j) is supplied to the other end of the retention capacitor 44). Meanwhile, FIG. 10B indicates the potential of the gate node g and the node h1 when the write period is ended (to be more precise, a time period within the write period after the time when the data signal Vd (j) is supplied to the other end of the retention capacitor 44). Hereinafter, potential of the gate node g after being changed is referred to as Vgate.

As shown in FIG. 8 and FIG. 9, during the compensation period and the write period, the retention capacitors 50 and 132 are electrically connected in parallel. Accordingly, a capacity value C0 of combined capacitance of the retention capacitors 50 and 132 is expressed by Equation 1 as follows.

$$C0=C\text{pix}+Cdt \qquad \text{Equation 1}$$

Accordingly, when the charge which is accumulated in the combined capacitance of the retention capacitors 50 and 132 at the end of the compensation period is referred to as Q0*a* (FIG. 10A), and charge which is accumulated in the combined capacitance thereof at the end of the write period is referred to as Q0*b* (FIG. 10B), charge that flows out from the combined capacitance of the retention capacitors 50 and 132 during the write period (Q0*a*−Q0*b*) is expressed by Equation 2 as follows.

$$Q0a-Q0b=C0\times(Vp-V\text{gate}) \qquad \text{Equation 2}$$

Likewise, if charge which is accumulated in the retention capacitor 44 at the end of the compensation period is referred to as Q1*a* (FIG. 10A), and charge which is accumulated in the retention capacitor 44 at the end of the write period is referred to as Q1*b* (FIG. 10B), charge that flows into the retention capacitor 44 during the write period (Q1*b*−Q1*a*) is expressed by Equation 3 as follows.

$$Q1b-Q1a=Crf1\times\{(V\text{gate}-Vd(j))-(Vp-V\text{ref})\} \qquad \text{Equation 3}$$

During the write period, since the charge that flows out from the combined capacitance of the retention capacitors 50 and 123 and the charge that flows into the retention capacitance 44 are equal to each other in quantity, Equation 4 described below holds.

$$Q0a-Q0b=Q1b-Q1a \qquad \text{Equation 4}$$

Accordingly, using Equations 1 through 3, the potential Vgate of the gate node g during the write period can be calculated. More specifically, the potential Vgate is expressed by Equation 5 as follows.

$$V\text{gate}=\{Crf1/(Crf1+C0)\}\times\{Vd(j)-V\text{ref}\}+Vp \qquad \text{Equation 5}$$

Here, if a capacitance ratio k1 indicated in Equation 6 described below is introduced, the potential Vgate can be expressed also by Equation 7 described below.

$$k1=Crf1/(Crf1+Cdt+C\text{pix}) \qquad \text{Equation 6}$$

$$V\text{gate}=k1\times\{Vd(j)-V\text{ref}\}+Vp \qquad \text{Equation 7}$$

Equation 8 described below holds in this case, where the amount of potential change of the node h1 {Vd(j)−Vref} is indicated by ΔV and the amount of potential change of the gate node g (Vgate−Vp) is indicated by ΔVg.

$$\Delta Vg=k1\times\Delta V \qquad \text{Equation 8}$$

In this manner, the gate node g is shifted upward in potential from the potential Vp=(Vel−|Vth|) during the compensation period by the quantity obtained through multiplying ΔV, which is the amount of potential change of the node h1, by the capacitance ratio k1 (k1×ΔV) so as to be at the potential Vgate=Vel−|Vth|+k1×ΔV.

At this time, an absolute value of the voltage |Vgs| of the transistor 121 Vgs is obtained by subtracting the amount of the upward potential shift of the gate node g from the threshold voltage |Vth|. In other words, Equation 9 described below holds.

$$|Vgs|=|Vth|-k1\times\Delta V \qquad \text{Equation 9}$$

Figure 11:
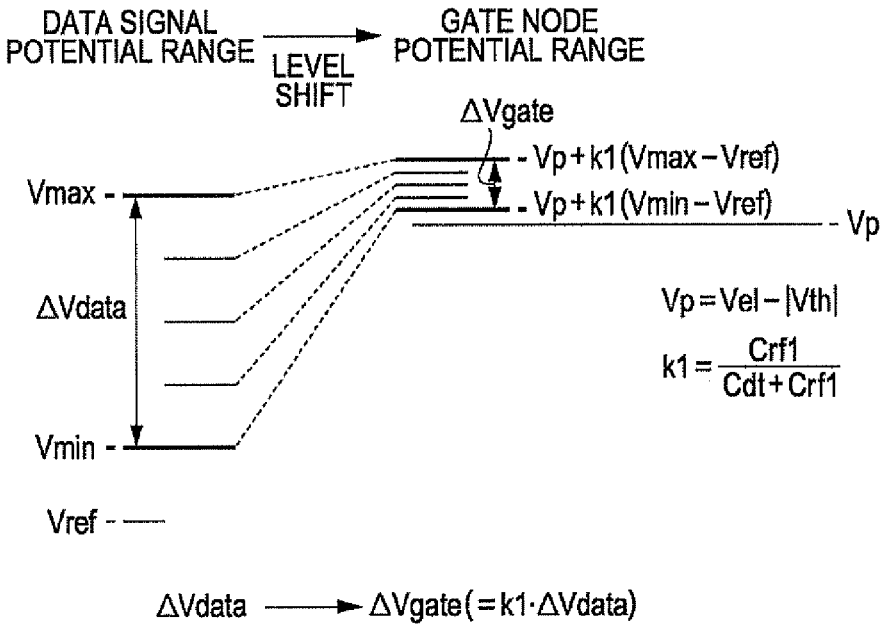
FIG. 11 is a descriptive diagram illustrating amplitude compression of a data signal in the electro-optical device according to the first embodiment of the invention.

FIG. 11 is a diagram illustrating a relationship between potential of a data signal and potential of the gate node g during the write period. The data signal supplied from the driving control circuit 5 can take a potential value ranging from the minimum value Vmin to the maximum value Vmax, as describe before, according to the tone level of the pixel. In this embodiment, the data signal is not directly inputted to the gate node g, but is inputted to the gate node g after experiencing level-shift processing as shown in the drawing.

At this time, a potential range ΔVgate of the gate node g is compressed to a value obtained by multiplying a potential range of the data signal ΔVdata (=Vmax−Vmin) by the capacitance ratio k1, as expressed by Equation 10 below.

$$\Delta V\text{gate}=k1\times\Delta V\text{data} \qquad \text{Equation 10}$$

As described above, the capacity value Cpix is sufficiently smaller than the capacity value Crf1 and the capacity value Cdt; if the capacity values of the retention capacitors 44 and 50 are set in a manner such that Crf1:Cdt=1:9, the potential range ΔVgate of the gate node g can be compressed to one tenth of the potential range of the data signal ΔVdata.

It is to be noted that the potential Vp (=Vel−|Vth|) and the potential Vref are key factors in determining a level-shift amount and direction of the potential range ΔVgate of the gate node g with respect to the potential range of the data signal ΔVdata. The reason for this is as follows. That is, the potential range of the data signal ΔVdata is compressed by the capacitance ratio k1 with the potential Vref as a base potential, the compressed potential range is shifted with respect to the potential Vp as a base potential, and then the shifted potential becomes the potential range ΔVgate of the gate node g.

As described above, during the write period of the i-th row, the potential (Vel−|Vth|+k1×ΔV) that has shifted from the potential Vp (=Vel−|Vth|) of the compensation period by the quantity obtained through multiplying the amount of the potential change ΔV of the node h1 by the capacitance ratio k1, is written into the gate node g of the pixel circuit 110 of the i-th row.

Light Emission Period

After the write period of the i-th row is ended, the light emission period is started. In this embodiment, when a one-horizontal scanning period has passed since the end of the write period of the i-th row, the light emission period is started. During the light emission period, since the scanning line driving circuit 20 sets the scanning signal Gwr (i) to H-level, as described above, the transistor 122 is turned OFF. With this, potential of the gate node g is kept at the shifted potential (Vel−|Vth|+k1×ΔV). Further, during the light emission period, since the scanning line driving circuit 20 sets the control signal Gel (i) to L-level, as described above, the transistor 124 is turned ON in the pixel circuit 110 in the i-th row and the (3j−2)-th column. Since the voltage Vgs between the gate and the source is (|Vth|−k1×ΔV), an electric current in accordance with the tone level is supplied to the OLED 130 while compensating the threshold voltage of the transistor 121, as indicated in FIG. 6.

The operations described above are also executed in other i-th row pixel circuits 110 than the i-th row pixel circuit 110 of the (3j−2)-th column in parallel at the same time during the i-th row scanning period. In addition, the above-mentioned operations executed in the i-th row are actually executed in the order of the 1st, 2nd, 3rd, . . . , (m−1)-th, and m-th row during a one-frame period and repeatedly executed every frame.

According to this embodiment, because the potential range ΔVgate of the gate node g is narrowed with respect to the potential range ΔVdata of the data signal, it is possible to apply voltage in accordance with the tone level between the gate and the source of the transistor 121 without processing the data signal in a precisely fined manner. Accordingly, in the pixel circuit 110, even if a minute electric current that flows in the OLED 130 is changed largely relative to the change of the voltage Vgs between the gate and source of the transistor 121, it is possible to precisely control the electric current supplied to the OLED 130.

Note that the transistor 121 supplies the electric current Ids in proportion to the voltage Vgs between the gate and the source indicated by Equation 8 to the OLED 130. The OLED 130 emits light with the luminance according to the quantity of the electric current Ids.

Therefore, in the case where the potential range ΔVgate of the gate node g is compressed with respect to the potential range ΔVdata of the data signal, it is difficult for the OLED 130 to emit light with high luminance in comparison with a case without the potential range compression. In this case, a screen on which the display portion 100 displays an image is generally dark.

On the other hand, in this embodiment, the driving control circuit 5 controls the potential Vref based on the brightness information Br. Specifically, when the brightness of an entire screen to be displayed by the display portion 100 is higher, the driving control circuit 5 sets the Vref to a higher potential. Through this, the voltage Vgs can be made higher; as a result, it is possible to display a brighter image and enhance the precision control of the electric current Ids at the same time.

Furthermore, as illustrated with a broken line in FIG. 4, a parasitical capacitor Cprs is present between the data line 14 and the gate node g in the pixel circuit 110 in some case. In this case, if the width change in potential of the data line 14 is large, such potential change unfavorably propagates to the gate node g via the Cprs so as to cause crosstalk, unevenness or the like, resulting in lowering the display quality. Influence of the capacitor Cprs is apparently large in the case where the pixel circuit 110 is micro-fabricated.

Meanwhile, in this embodiment, since the range of potential change of the data line 14 is narrowed with respect to the potential range ΔVdata of the data signal, the influence via the capacitor Cprs can be suppressed.

Moreover, according to this embodiment, the electric current Ids is supplied to the OLED 130 by the transistor 121 while cancelling out influence of the threshold voltage. Therefore, according to this embodiment, even if the threshold voltage of the transistor 121 varies depending on the pixel circuits 110, electric current in accordance with the tone level is supplied to the OLED 130 while compensating the threshold voltage for its variation. This suppresses the occurrence of display unevenness that spoils uniformity of a display screen so that a high-quality image can be displayed.

The cancelling-out of the influence of the threshold voltage is explained below with reference to FIG. 12. As shown in the drawing, the transistor 121 is driven in a subthreshold region so as to control a minute electric current that is supplied to the PLED 130.

Figure 12:
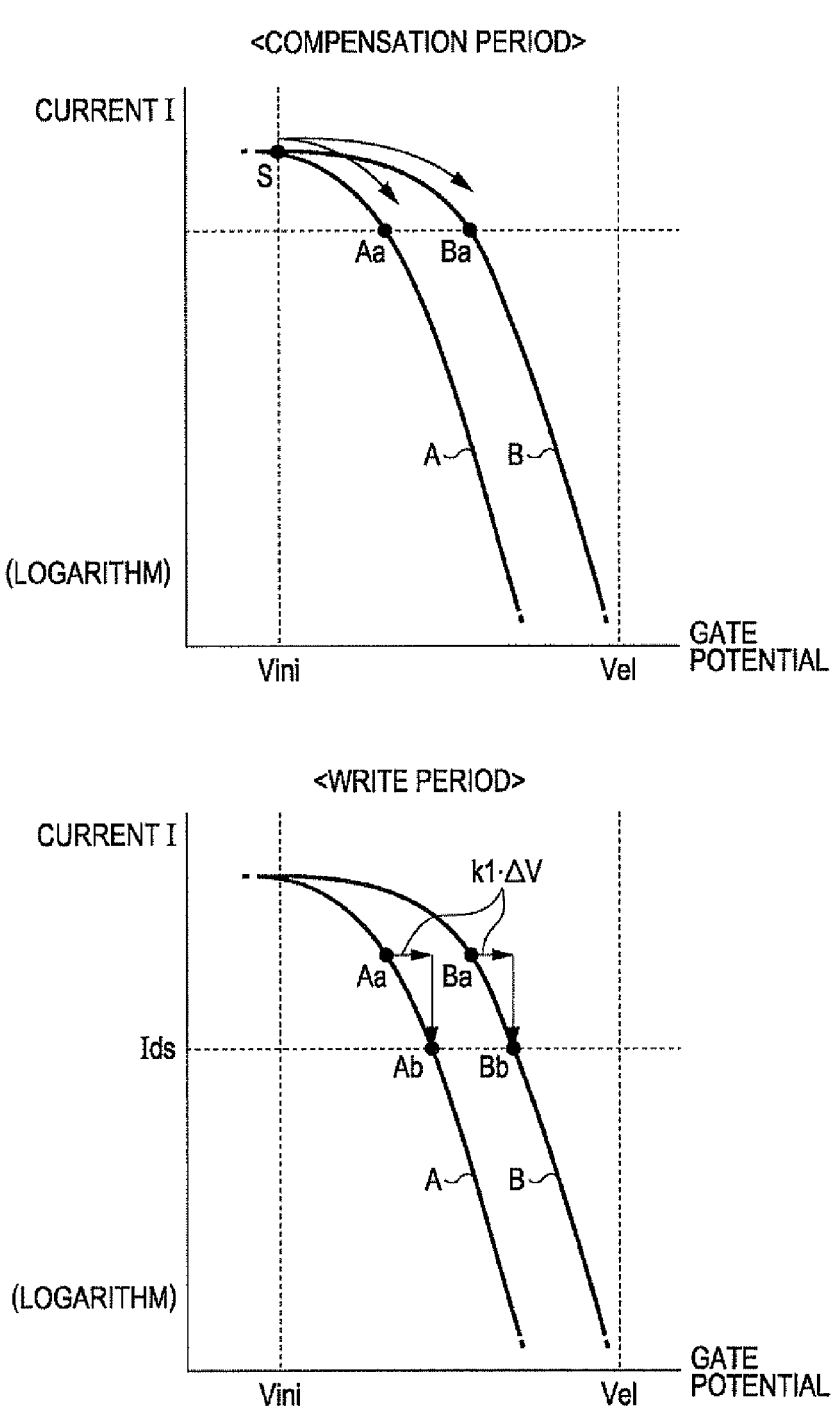
FIG. 12 shows descriptive diagrams indicating characteristics of a transistor in the electro-optical device according to the first embodiment of the invention.

In FIG. 12, a symbol "A" denotes a transistor with a larger threshold voltage |Vth|, while a symbol "B" denotes a transistor with a smaller threshold voltage |Vth|. The voltage Vgs between the gate and the source is a difference between a characteristic illustrated with a solid line and the potential Vel in FIG. 12. In FIG. 12, an electric current on the longitudinal scale is indicated in a logarithmic display in which a direction of the electric current that flows from the source to the drain is defined as a negative direction (downward on the scale).

During the compensation period, the gate node g shifts from the potential Vref_H to the potential (Vel−|Vth|). With this, the operating point of the transistor A with a larger threshold voltage |Vth| moves from S to Aa, and the operating point of the transistor B with a smaller threshold voltage |Vth| moves from S to Ba.

Next, in the case where potential values of the data signals supplied to the pixel circuit 110 in which the two transistors are include are the same, that is, in the case where the same tone level is require, the amount of potential shift from the operating point Aa and the amount of potential shift from the operating point Ba are the same of the value k1×ΔV during the write period. Accordingly, the operating point of the transistor A moves from Aa to Ab and the operating point of the transistor B moves from Ba to Bb; however, the electric current of the transistor A and the electric current of the transistor B at each operating point after the potential shift, are approximately the same current value of Ids.

Second Embodiment

In the first embodiment, data signals are supplied directly to the other end of the retention capacitor 44 of each column, i.e., to the node h1 by the demultiplexer DM. For this reason, in the scanning period of each row, since a time period during which the data signal is supplied from the driving control circuit 5 coincides with the write period, there exists a temporal restriction that is strictly imposed upon the operation of the device.

Hereinafter, a second embodiment of the invention capable of alleviating such temporal restriction will be described. Note that in order to avoid redundant descriptions, the following descriptions will be made mainly focusing on different portions from those of the first embodiment.

Figure 13:
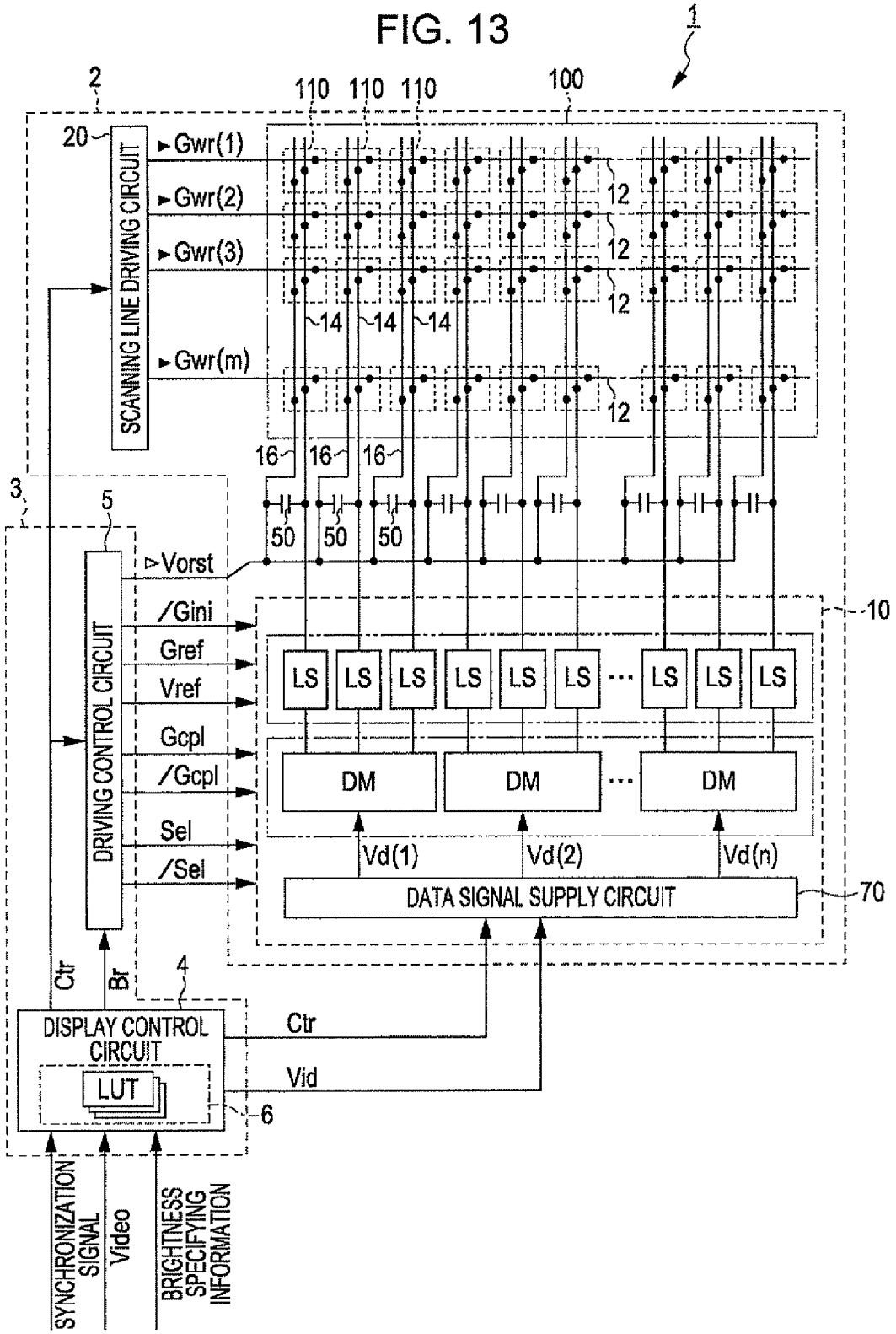
FIG. 13 is a diagram illustrating the configuration of an electro-optical device according to a second embodiment.
Figure 14:
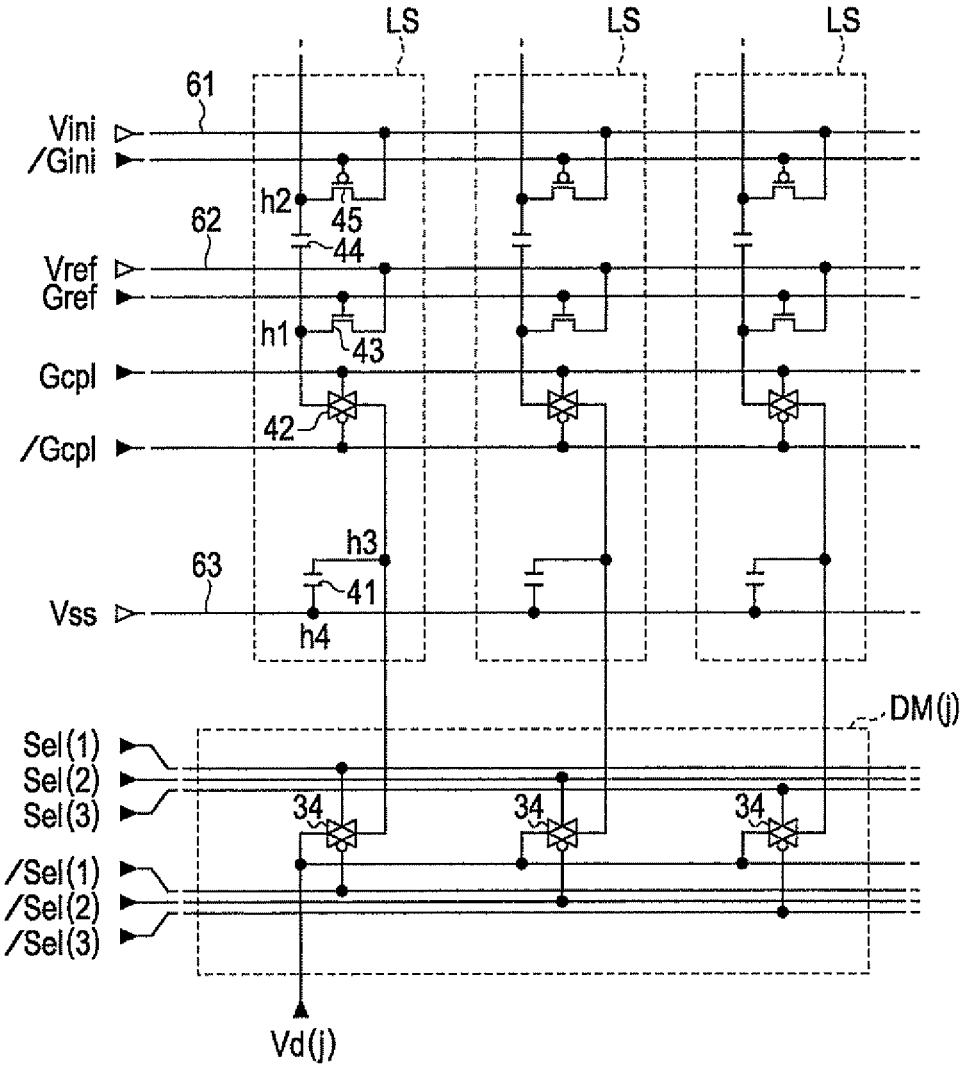
FIG. 14 is a diagram illustrating a driving control circuit of the electro-optical device according to the second embodiment.

FIGS. 13 and 14 are diagrams illustrating the configuration of an electro-optical device 1 according to a second embodiment of the invention. The second embodiment illustrated in FIGS. 13 and 14 differs from the first embodiment illustrated in FIGS. 2 and 3 mainly in that a fourth retention capacitor 41 (fourth retention capacitor) and a transmission gate 42 (first switch) are provided in each of the level shift circuit LS.

To be more specific, as shown in FIG. 14, the transmission gate 42 is electrically interposed between the output terminal of the transmission gate 34 and the other end of the retention capacitor 44. In other words, an input terminal of the transmission gate 42 is connected with the output terminal of transmission gate 34, and an output terminal of the transmission gate 42 is connected with the other end of the retention capacitor 44.

As shown in FIGS. 13 and 14, the driving control circuit 5 supplies a control signal Gcp1 and a control signal /Gcp1 for common use to the transmission gate 42 of each column. The transmission gates 42 of individual columns are turned ON all together when the control signal Gcp1 is at H-level (control signal /Gcp1 is at L-level).

In each column, a node h3 which is one end of the retention capacitor 41 is connected with the output terminal of the transmission gate 34 (and the input terminal of the transmission gate 42), a node h4 which is the other end of the retention capacitor 41 is connected with a fixed potential, i.e., a power line 63 (second power line) for common use to which potential Vss is supplied, for example. Although not shown in FIG. 14, the capacity value of the retention capacitor 41 is referred to as Crf2. Note that the potential Vss corresponds to the scanning signal as a logic signal, L-level of the control signals, and the like.

Operations of Second Embodiment

Figure 15:
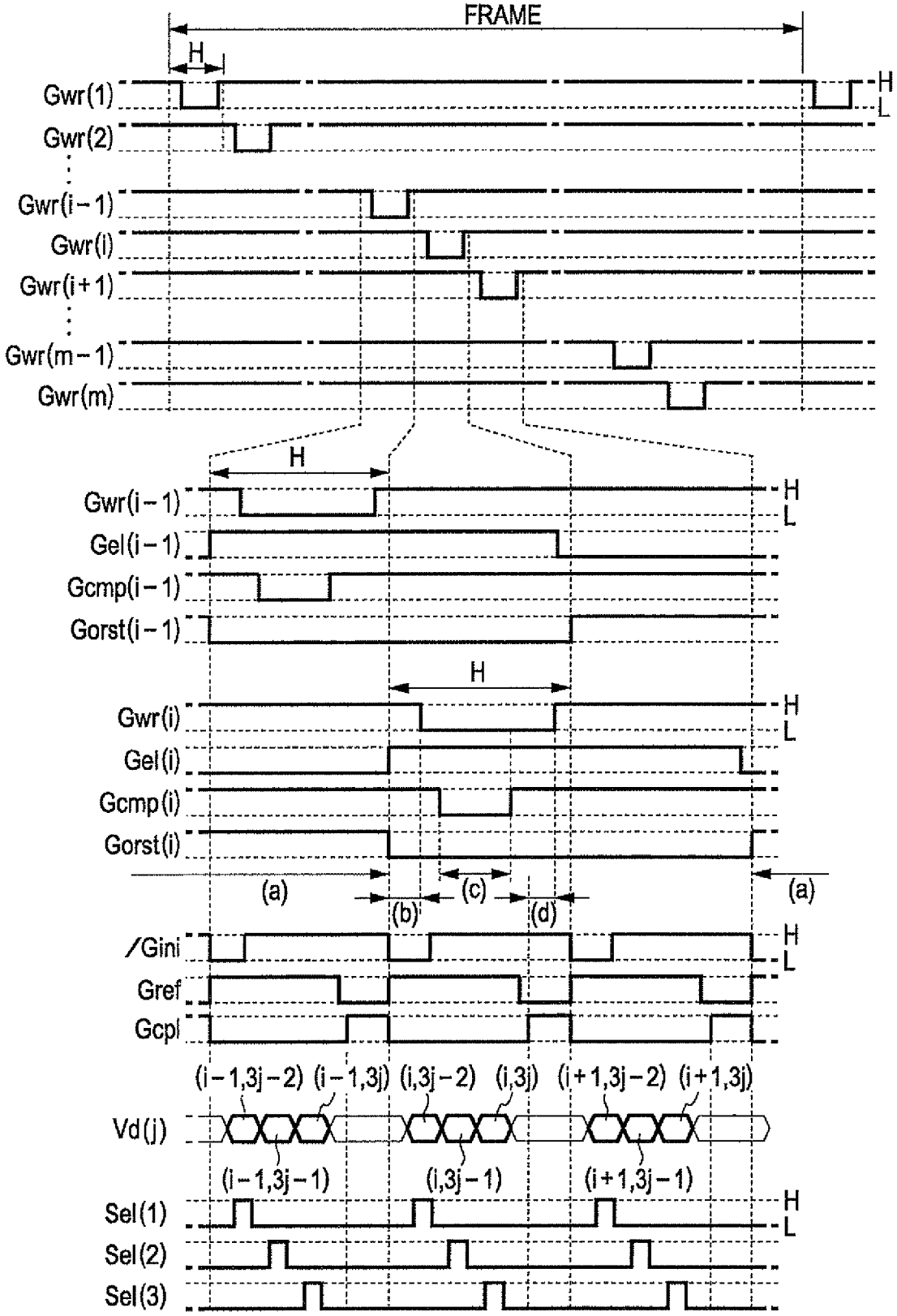
FIG. 15 is a timing chart illustrating operation of the electro-optical device according to the second embodiment.

Operations of the electro-optical device 1 according to the second embodiment will be described with reference to FIG. 15. FIG. 15 is a timing chart for explaining operations in the second embodiment.

As shown in FIG. 15, the scanning signals Gwr (1) through Gwr (m) are switched to L-level one after the other, and the scanning lines 12 of the 1st row through the m-th row are scanned during each one-horizontal scanning period (H) in series within a one-frame period. These operations described above are the same as those in the first embodiment. In addition, in the second embodiment, a scanning period of the i-th row includes the initialization period indicated by (b), the compensation period indicated by (c), and the write period indicated by (d) in this order. This is also the same as in the first embodiment. Note that in the second embodiment, the writing period of (d) is a time period from when the control signal Gcp1 is shifted from L to H-level (when the control signal /Gcp1 is shifted to L-level) to when the scanning signal Gwr is shifted from L to H-level.

Also in the second embodiment, like in the first embodiment, a cycle of a light emission period, an initialization period, a compensation period, a write period, and a light emission period in time sequence is repeated. However, in the second embodiment, a time period during which data signals are supplied does not coincide with the write period, and the data signal supply precedes the write period in comparison with the first embodiment. This is a different point from the first embodiment. To be more specific, in the second embodiment, unlike in the first embodiment, data signals are supplied during the initialization period of (b) and the compensation period of (c).

Light Emission Period

Figure 16:
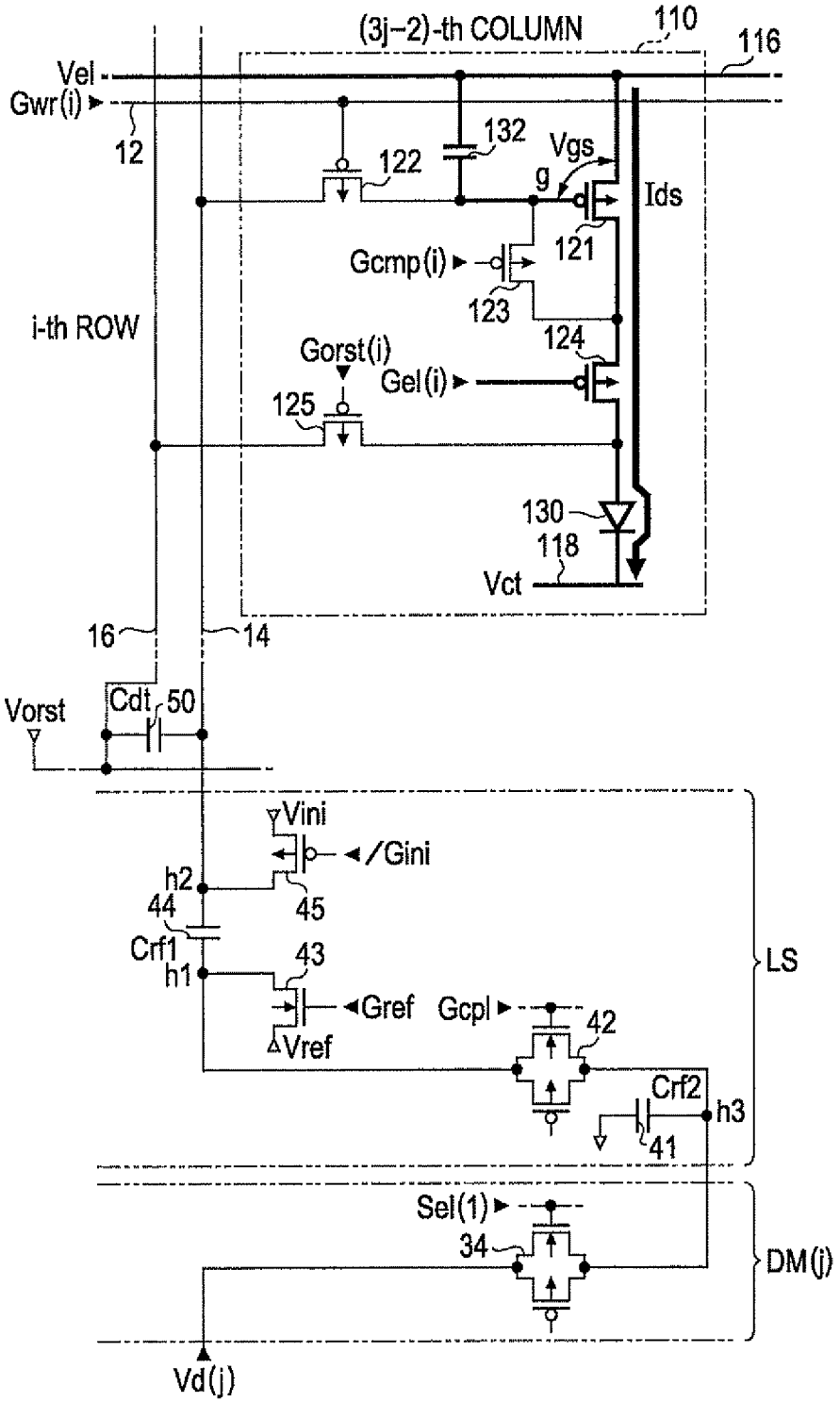
FIG. 16 is a diagram for explaining operation of the electro-optical device according to the second embodiment.

As shown in FIG. 15, in the light emission period of the i-th row, the scanning line driving circuit 20 sets the scanning signal Gwr (i) to H-level, the control signal Gel (i) to L-level, the control signal Gcmp(i) to H-level, and the control signal Gorst (i) to H-level, respectively. Accordingly, as shown in FIG. 16, in the pixel circuit 110 in the i-th row and the (3j−2)-th column, the transistor 124 is turned ON, and the transistors 122, 123 and 125 are turned OFF. Therefore, operations in the above pixel circuit 110 are basically the same as those in the first embodiment. In other words, the transistor 121 supplies the electric current Ids in proportion to the voltage Vgs between the gate and source nodes thereof to the OLED 130.

Initialization Period

Figure 17:
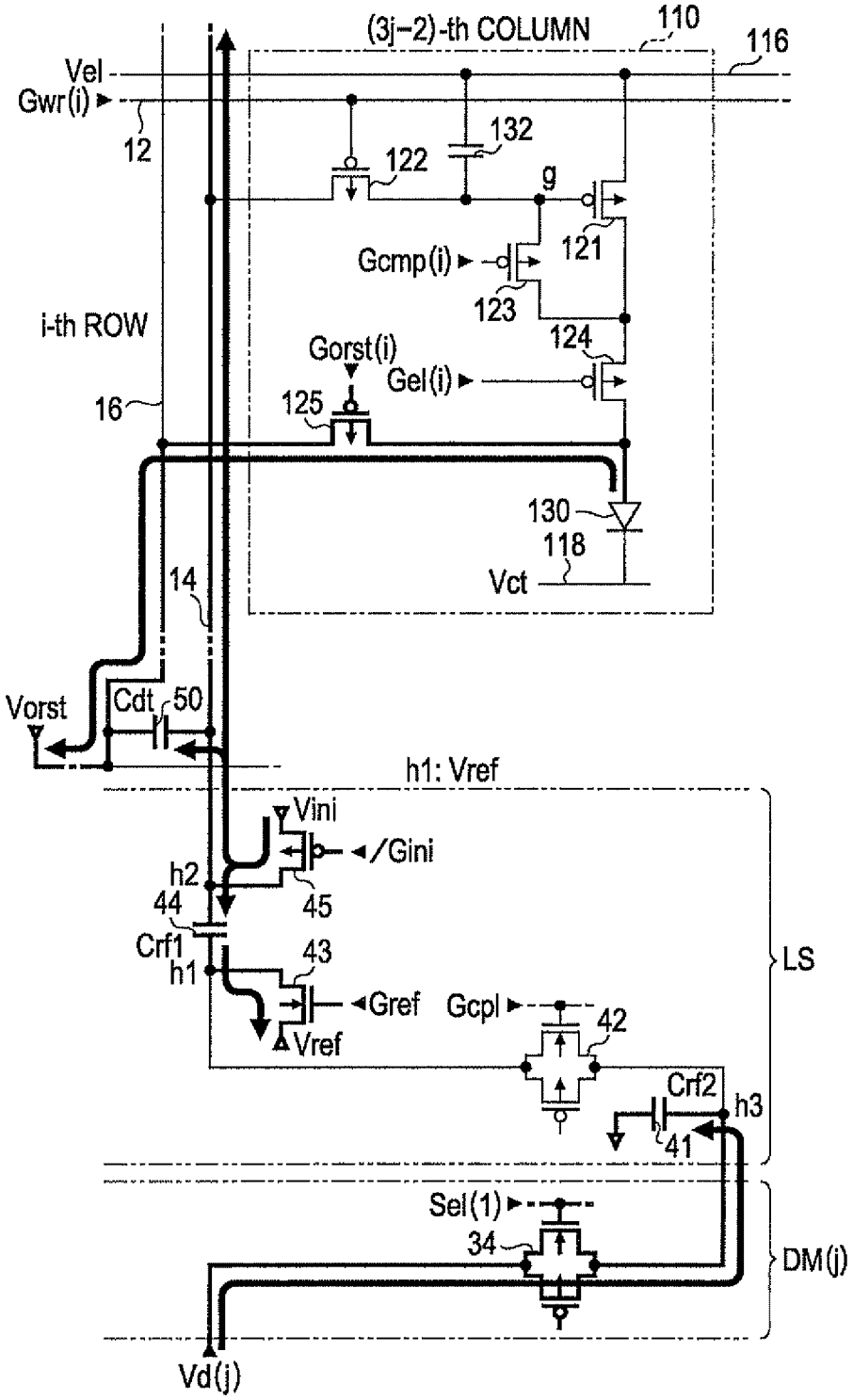
FIG. 17 is a diagram for explaining operation of the electro-optical device according to the second embodiment.

At the beginning of the i-th row scanning period, the initialization period of (b) (first period) starts first. As shown in FIG. 15, during the initialization period, the scanning line driving circuit 20 sets the scanning signal Gwr (i) to H-level, the control signal Gel (i) to H-level, the control signal Gcmp (i) to H-level, and the control signal Gorst (i) to L-level, respectively. Accordingly, as shown in FIG. 17, in the pixel circuit 110 in the i-th row and the (3j−2)-th column, the transistor 124 is turned OFF and the transistors 125 is turned ON. With this, a path of the electric current supplied to the OLED 130 is blocked and the anode of the OLED 130 is reset to the potential Vorst due to the transistor 124 being turned ON. Therefore, operations carried out in the above pixel circuit 110 are basically the same as those in the first embodiment.

Meanwhile, as shown in FIG. 15, the driving control circuit 5 sets the control signal /Gini to L-level, the control signal Gref to H-level and the control signal Gcp1 to L-level, respectively. Accordingly, as shown in FIG. 17, the transistors 43 and 45 are turned ON. Through this, the one end of the retention capacitor 44 and the power line 61 are initialized to the potential Vini, and the other end of the retention capacitor 44 is initialized to the potential Vref.

In the second embodiment, as described above, the data signal supply circuit 70 supplies the data signals during the initialization period and the compensation period. In other words, with regard to the j-th group, the data signal supply circuit 70 switches the data signal Vd (j) to potential corresponding to the tone level of a pixel in the i-th row and the (3j−2)-th column, the tone level of a pixel in the i-th row and the (3j−1)-th column and the tone level of a pixel in the i-th row and the (3j)-th column, in series. Meanwhile, in synchronization with the switching of the data signal potential, the driving control circuit 5 exclusively sets the control signals Sel (1), Sel (2) and Sel (3) to H-level in series. Through this, the three transmission gates 34 provided in each of the demultiplexers DM are turned ON in series in the order from the leftmost column to the central column, and the rightmost column.

In the case where the transmission gate 34 of the leftmost column which belongs to the j-th group is turned ON by the control signals Sel (1) in the initialization period, because the data signal Vd (j) is supplied, as shown in FIG. 17, to the one end of the retention capacitor 41, the above data signal is held by the retention capacitor 41.

Compensation Period

Figure 18:
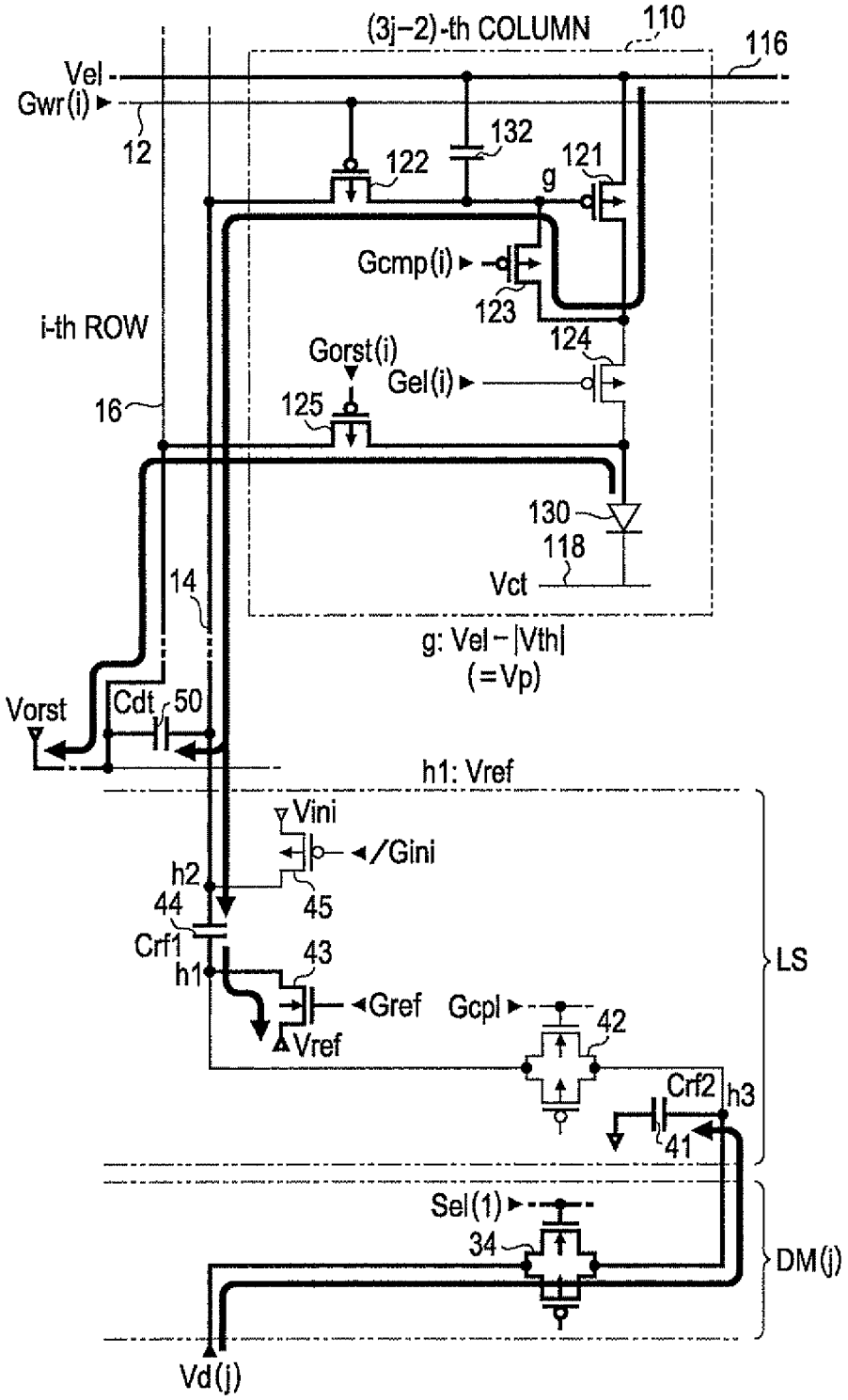
FIG. 18 is a diagram for explaining operation of the electro-optical device according to the second embodiment.

In the i-th row scanning period, the compensation period of (c) is started next. In the compensation period, as shown in FIG. 15, the scanning line control circuit 20 sets the scanning signal Gwr (i) to L-level, the control signal Gel (i) to H-level, the control signal Gcmp (i) to L-level and the control signal Gorst (i) to L-level, respectively. With this, as shown in FIG. 18, in the pixel circuit 110 in the i-th row and the (3j−2)-th column, the transistor 122 is turned ON and the gate node g is electrically connected with the data line 14, whereas the transistor 121 becomes a diode-connected transistor due to the transistor 123 being turned ON. With this, since the electric current flows in a path from the power line 116, the transistors 121, 123 and 122, and to the data line 14 of the (3j−2)-th column, the gate node g is raised in potential from the potential Vini and is saturated over time at the potential (Vel−|Vth|). Accordingly, the retention capacitor 132 retains the threshold voltage |Vth| of the transistor 121 until the compensation period is ended in the second embodiment as well.

Further, in the compensation period, as shown in FIG. 15, the driving control circuit 5 sets the control signal /Gini to H-level, the control signal Gref to H-level and the control signal Gcp1 to L-level, respectively. Accordingly, as shown in FIG. 18, the transistor 43 is turned ON and the transistor 45 is turned OFF in the level shift circuit LS. With this, the other end of the retention capacitor 44 and the power line 62 are electrically connected, and the node h1 is set to the potential Vref.

Moreover, during the compensation period, when the transmission gate 34 of the leftmost column which belongs to the j-th group is turned ON by the control signal Sel (1), the data signal Vd (j) is held by the retention capacitor 41, as shown in FIG. 18.

In the case where the transmission gate 34 of the leftmost column which belongs to the j-th group has already been turned ON by the control signal Sel (1) during the initialization period, the above-mentioned transmission gate 34 is not needed to be turned ON during the compensation period; however, the operation is the same in that the data signal Vd (j) is held by the retention capacitor 41.

When the compensation period is ended, the scanning line control circuit 20 changes the control signal Gcmp (i) from L-level to H-level. With this, the transistor 121 is released from its diode-connected state.

Moreover, when the compensation period is ended, the driving control circuit 5 changes the control signal Gref from H-level to L-level so that the transistor 43 is turned OFF. With this, although a path from the data line 14 of the (3j−2)-th column to the gate node g of the pixel circuit 110 in the i-th row and the (3j−2)-th column is caused to be in a floating state. However, potential of the path is retained by the retention capacitors 50 and 132 at potential (Vel−|Vth|).

Write Period

Figure 19:
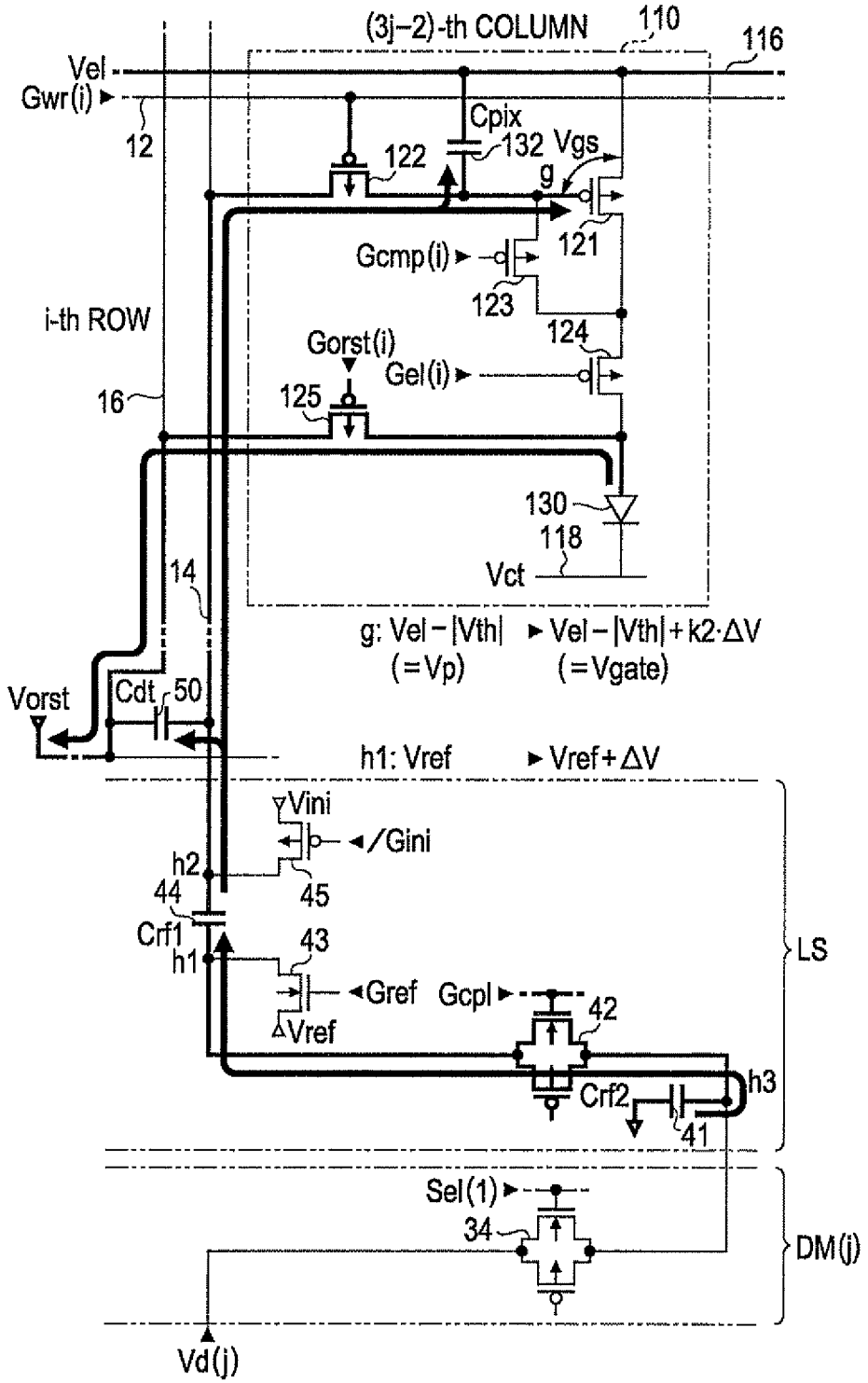
FIG. 19 is a diagram for explaining operation of the electro-optical device according to the second embodiment.

In the scanning period of the i-th row, the write period of (d) is started next. During the write period, as shown in FIG. 15, the driving control circuit 5 sets the control signal /Gini to H-level, the control signal Gref to L-level and the control signal Gcp1 to H-level, respectively. With this, as shown in FIG. 19, since the transmission gate 42 is turned ON in the level shift circuit LS, the data signal held by the retention capacitor 41 is supplied to the node h1 which is the other end of the retention capacitor 44. Through this, the node h1 is shifted from the potential Vref of the compensation period. In other words, the node h1 is changed to potential (Vref+ΔVh). Note that the potential (Vref+ΔVh) is referred to as potential Vh in some case.

Figure 20A:
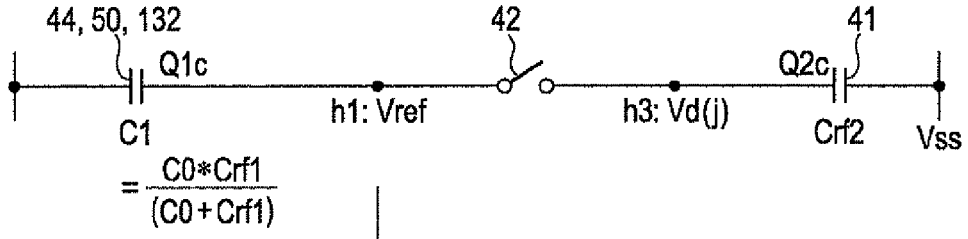
FIGS. 20A and 20B are diagrams for explaining potential width compression of a data signal in the electro-optical device according to the second embodiment of the invention.
Figure 20B:
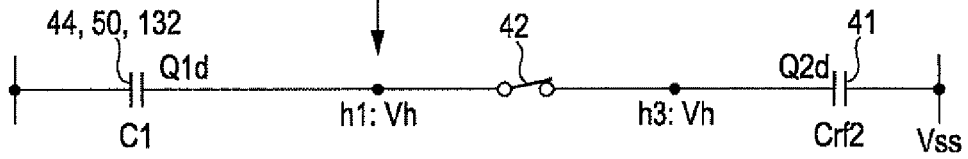

FIGS. 20A and 20B are diagrams for explaining an amount of potential change ΔVh of the node h1 before/after the start of write period. FIG. 20A illustrates potential of the node h1 before the start of the write period, and FIG. 20B illustrates potential of the node h1 after the start of the write period, that is, during a time period after the transmission gate 42 is turned ON.

As shown in FIG. 18 and FIG. 19, during the compensation and write periods, the retention capacitors 50 and 132 are electrically connected in parallel, and the retention capacitor 44 is electrically connected in series with these retention capacitors 50 and 132. Accordingly, a capacity value C1 of combined capacitance of the retention capacitors 44, 50 and 132 is given by Equation 11 as follows using the capacity value C0 of Equation 1.

$$C1=(C0\times Crf1)/(C0+Crf1) \quad \text{Equation 11}$$

Therefore, when a charge having been accumulated in the combined capacitance of the retention capacitors 44, 50 and 132 before the start of the write period is referred to as Q1*c* (FIG. 20A), and a charge accumulated in the combined capacitance of these capacitors after the start of the write period is referred to as Q1*d* (FIG. 20B), the charge that flows out from the combined capacitance during the write period (Q1*c*−Q1*d*) is given by Equation 12 described below.

$$Q1c-Q1d=C1\times(Vref-Vh) \quad \text{Equation 12}$$

Likewise, when a charge having been accumulated in the retention capacitor 41 before the start of the write period is referred to as Q2*c* (FIG. 20A), and a charge accumulated in the retention capacitor 41 after the start of the write period is referred to as Q2*d* (FIG. 20B), the charge that flows into the retention capacitor 41 during the write period (Q2*d* Q2*c*) is given by Equation 13 as follows.

$$Q2d-Q2c=Crf2\times(Vh-Vd(j)) \quad \text{Equation 13}$$

Since the charge that flows out from the combined capacitance of the retention capacitors 44, 50 and 132 is equal in quantity to the charge that flows into the retention capacitor 41, Equation 14 described below holds.

$$Q1c-Q1d=Q2d-Q2c \quad \text{Equation 14}$$

Therefore, using Equations 12 through 14, the potential Vh of the node h1 during the write period can be calculated. To be more specific, the potential Vh is given by Equation 15 as follows.

$$VH=\{C1/(C1+Crf2)\}\times(Vref)+\{Crf2/(C1+Crf2)\}\times\{Vd\ (j)) \quad \text{Equation 15}$$

Accordingly, an amount of potential change ΔVh at the node h1 is expressed by Equation 16 below.

$$\Delta Vh=Vh-Vref=\{Crf2/(C1+Crf2)\}\times\{Vd\ (j)-Vref\} \quad \text{Equation 16}$$

If a capacitance ratio k2 indicated by Equation 17 described below is introduced, the amount of potential change ΔVh can be expressed by Equation 18 described below.

$$k2=Crf2/(C1+Crf2) \quad \text{Equation 17}$$

$$\Delta Vh=k2\times\{Vd(j)Vref\} \quad \text{Equation 18}$$

Further, during the write period, the scanning line driving circuit 20 sets, as shown in FIG. 15, the scanning signal Gwr (i) to L-level, the control signal Gel (i) to H-level, the control signal Gcmp (i) to H-level and the control signal Gorst (i) to L-level, respectively.

At this time, because the gate node g is connected with the one end of the retention capacitor 44 via the data line 14, the potential thereof is shifted from the potention Vp=(Vel−|Vth|) of the compensation period. A potential change of the gate node g in this case is as has been explained by Equations 1 through 10 and FIGS. 10 and 11.

Specifically, in the case of the aforementioned first embodiment, potential of the node h1 changes before/after the start of the write period, i.e., from potential Vref before the start to potential specified by the data signal Vd (j) after the start; in the case of the second embodiment, it changes from the potential Vref to the potential Vh. Accordingly, the potential Vgate of the gate node g during the write period can be calculated by substituting Vh in Equation 15 for Vd (j) in Equation 7. To be more specific, the potential Vgate is given by Equation 19 as follows.

$$Vgate = k1 \times \Delta Vh + (Vel - |Vth|) \quad \text{Equation 19}$$
$$= k1 \times k2 \times \{Vd(j) - Vref\} + (Vel - |Vth|)$$

Furthermore, the amount of potential change ΔVg of the gate node g before/after the start of the write period can be calculated by substituting ΔVh in Equation 18 for ΔV in Equation 8. To be specific, the amount of potential change ΔVg is given by Equation 20 as follows.

$$\Delta Vg = k1 \times \Delta Vh \quad \text{Equation 20}$$
$$= k1 \times k2 \times \{Vd(j) - Vref\}$$

As described thus tar, the potential of the node h1 is changed by the quantity which is obtained in the following manner; that is, the potential specified by the data signal Vd (j) is shifted with the potential Vref, and the shifted potential is compressed by the capacitance ratio k2 so as to obtain the above quantity. With this, the potential Vgate of the gate node g is changed by the quantity, which is obtained through further compressing the amount of potential change ΔVh of the node h1 by the capacitance ratio k1.

In other words, the data signal Vd (j) is shifted with the potential Vref, and the shifted potential is multiplied by the capacitance ratios (capacitance ratios k1, k2), which are defined based on the capacity values Cdt, Crf1, Crf2 and Cpix, so as to obtain a compressed potential; this compressed potential is supplied to the potential Vgate of the gate node g.

Light Emission Period

In the second embodiment, the light emission period starts after the write period of the i-th row is ended. During the light emission period, as described above, since the scanning line driving circuit 20 sets the control signal Gel (i) to L-level, the transistor 124 is turned ON in the pixel circuit 110 in the i-th row and the (3j−2)-th column. Accordingly, as shown in FIG. 16, an electric current according to the tone level is supplied to the OLED 130 while compensating the threshold voltage of the transistor 121.

The operations described above are also executed in other i-th row pixel circuits 110 than the i-th row pixel circuit 110 of the (3j−2)-th column in parallel at the same time during the i-th row scanning period. In addition, the above-described operations executed in the i-th row are actually executed in the order of the 1st, 2nd, 3rd, . . . , (m−1)-th, and m-th row during a one-frame period and repeatedly executed every frame.

According to the second embodiment, like in the first embodiment, even if a minute electric current that flows in the OLED 130 is changed largely relative to the voltage Vgs between the gate and source of the transistor 121 in the pixel circuit 110, it is possible to precisely control the electric current supplied to the OLED 130.

Moreover, according to the second embodiment, like in the first embodiment, it is possible for the OLED 130 to emit light with high luminance by setting the potential Vref to a high potential without setting potential of the data signal Vd (j) to a high potential, thereby making it possible for the electro-optical device 1 to display a brighter image.

According to the second embodiment, like in the first embodiment, the voltage retained by parasitic capacitance of the OLED 130 can be sufficiently initialized during the light emission period, and the occurrence of display unevenness that spoils uniformity of the display screen can be prevented even if the threshold voltage of the transistor 121 varies depending on the pixel circuits 110. This makes it possible to display a high-quality image.

According to the second embodiment, an operation in which a data signal supplied from the driving control circuit 5 via the demultiplexer DM is retained by the retention capacitor 41, is executed from the initialization period through the compensation period. This alleviates a temporal restriction imposed upon operations to be executed during a one-horizontal scanning period.

For example, during the compensation period, as the voltage Vgs between the gate and source comes to be closer to the threshold voltage, the quantity of electric current that flows in the transistor 121 decreases, accordingly, it takes a longer time for the gate node g to converge with potential (Vel−|Vth|). However, in the second embodiment, as indicated in FIG. 15, the compensation period is ensured to be longer than that in the first embodiment. Accordingly, the configuration of the second embodiment can precisely compensate variation of the threshold voltage of the transistor 121. In addition, operational speed of data signal supply can be lowered.

Applications and Variations

The invention is not limited to the above-described embodiments and application examples. For example, various kinds of variations described below can be made. Moreover, the following variations can be combined with an arbitrarily selected one or arbitrarily selected plural variations in an appropriate manner.

Variations

The invention is not limited to the above-described embodiments and application examples. For example, various kinds of variations described below can be made. Moreover, the following variations can be combined with an arbitrarily selected one or arbitrarily selected plural variations in an appropriate manner.

Variation 1

In the aforementioned embodiments, the controller 3 and display panel 2 are provided as separate entities; however, the controller 3 can also be integrated on a silicon substrate together with the display portion 100, the data line driving circuit 10, and the scanning line driving circuit 20.

Variation 2

In the above embodiments and variations, the electro-optical device 1 is configured as being integrated on a silicon substrate; however, it may be integrated on other semiconductor substrates, for example, an SOI substrate. The device may be formed on a glass substrate in which a polysilicon process technique is applied. Any of the materials mentioned above is effective in the case where the pixel circuit 100 is micro-fabricated and the quantity of the drain current changes in an exponential manner with respect to the change of the gate voltage Vgs.

Note that the invention may be applied in a case where micro-fabrication of the pixel circuit is not needed.

Variation 3

In the aforementioned embodiments and variations, the data lines 14 are grouped every three columns, and data lines 14 in each group are selected in series so as to supply the data signal. However, the number of the data lines to configure each group may be equal to or greater than 2 and equal to or less than 3n as a predetermined number. For example, the number of the data lines may be 2 or may be equal to or greater than 4.

Such a configuration may be employed in which the grouping of the data lines is not carried out, that is, the demultiplexer DM is not used in the device so that the data signals are supplied to the data lines 14 line-sequentially.

Variation 4

In the aforementioned embodiments and variations, the transistors 121 through 125 used in the pixel circuit 110 are unified to a P-channel type; however, the transistors may be unified to an N-channel type instead. It may be acceptable that P-channel type and N-channel type transistors are combined as needed.

Figure 24:
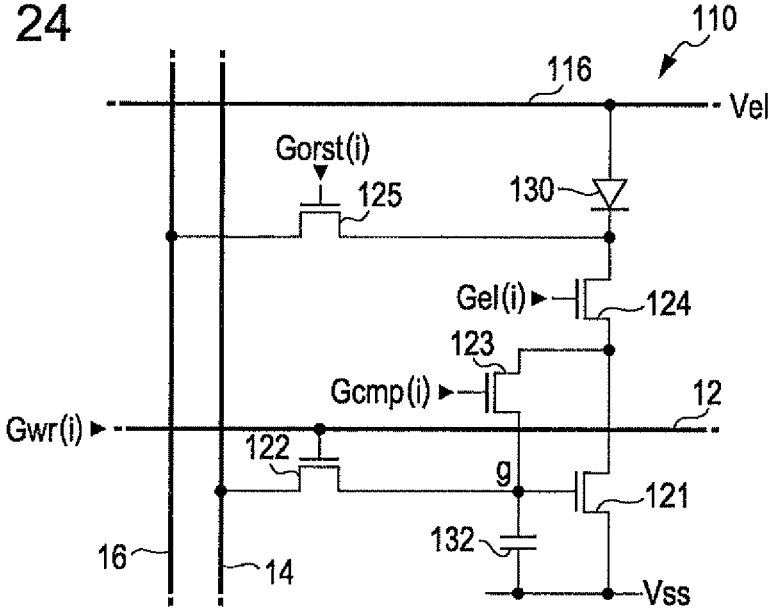
FIG. 24 is a diagram illustrating a pixel circuit of variation 4.

FIG. 24 is a circuit diagram illustrating the pixel circuit 110 according to variation 4. In the pixel circuit 110 according to variation 4, as shown in FIG. 24, the transistors 121 through 125 are unified to an N-channel type. As shown in FIG. 24, in the case where the transistors 121 through 125 are unified to an N-channel type, it is sufficient that the potential whose polarity is inverted with respect to the data signal Vd (j) of the aforementioned embodiments and variations is supplied to the pixel circuit 110.

In the above embodiments or the like, although the transistor 45 is a P-channel type transistor whereas the transistor 43 is an N-channel type transistor, they may be unified to be a P-channel or N-channel type. Further, the transistor 45 may be an N-channel type and the transistor 43 may be a P-channel type.

Variation 5

In the above embodiments and variations, each of the retention capacitors 50 is a single retention capacitor formed by sandwiching an insulating material (dielectric material) between the power line 16 and the data line 14 neighboring each other. However, each of the retention capacitors 50 may be formed with a plurality of capacitive elements. In this case, it is preferable for the driving control circuit 5 to carry out control operation in which a part of or all of the plurality of capacitive elements are selected based on the brightness information Br and the selected capacitive elements are electrically connected with the power line 16 and data line 14.

Figure 21:
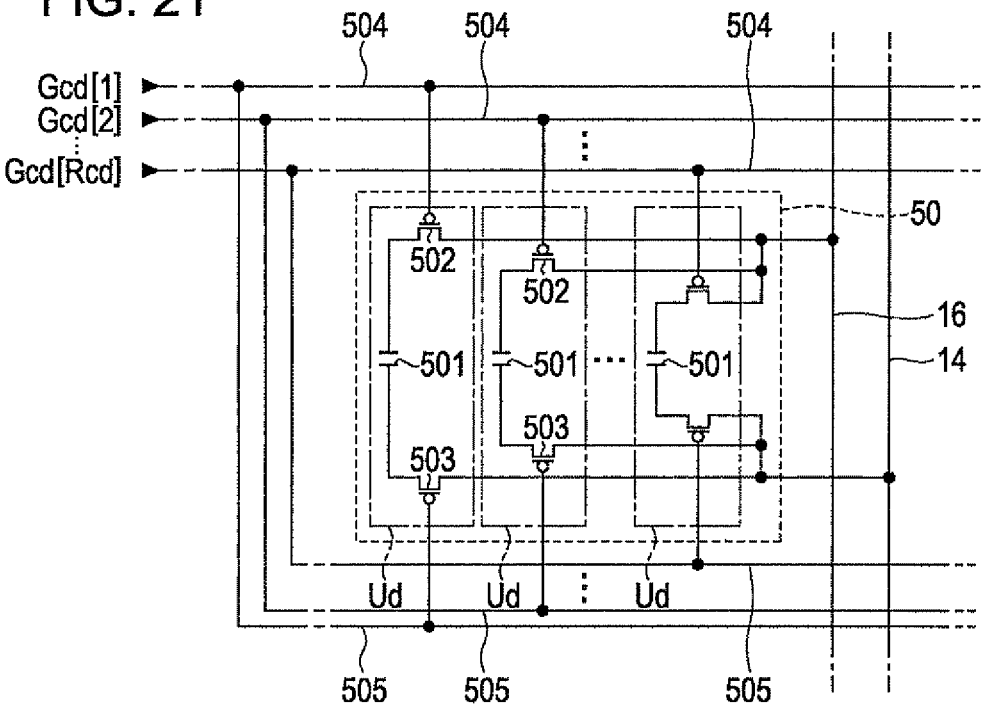
FIG. 21 is a diagram illustrating the configuration of a retention capacitor of variation 5.

FIG. 21 is a circuit diagram illustrating the configuration of a retention capacitor 50 according to variation 5. The retention capacitor 50 according to variation 5 includes unit circuits Ud (first unit circuit) of a predetermined number Rcd that are electrically connected with the data line 14 and the power line 16 neighboring each other, where the predetermined number Rcd is a natural number equal to or greater than 2.

Each of the unit circuits Ud includes a retention capacitor 501 (first unit capacitor) and transistors 502 and 503 electrically connected in series between the data line 14 and the power line 16. To be more specific, each of the unit circuits Ud includes the retention capacitor 501, the transistor 502 electrically connected between one end of the retention capacitor 501 and the power line 16, and the transistor 503 electrically connected between the other end of the retention capacitor 501 and the data line 14.

All of capacity values of the retention capacitors 501 of the predetermine number Rcd may be the same, or they may differ from each other. For example, in the case of Rcd=3, a capacitance ratio of the three different retention capacitors 501 included in the retention capacitor 50 may be (1:1:1) or (1:2:4).

In the display panel 2 according to variation 5, control lines 504 of the predetermined number Rcd and control lines 505 of the predetermined number Rcd are provided so as to correspond to the unit circuits Ud of the predetermined number Rcd in a one-to-one correspondence manner. The gate of the transistor 502 included in a certain unit circuit Ud is electrically connected with the control line 504 corresponding to the unit circuit Ud, and the gate of the transistor 503 included in the unit circuit Ud is electrically connected with the control line 505 corresponding to the unit circuit Ud.

Further, the driving control circuit 5 according to variation 5 generates, based on the brightness information Br, control signals Gcd (1), Gcd (2), . . . , Gcd (Rcd), and supplies each of these control signals Gcd of the predetermined number Rcd to each of the control lines 504 of the predetermined number Rcd and each of the control lines 505 of the predetermined number Rcd. Through this, the driving control circuit 5 can select, based on the brightness information Br, part of or all of the retention capacitors 501 from among the retention capacitor 501 of the predetermined number Rcd and electrically connect the selected retention capacitors 501 to the data line 14 and the power line 16. In other words, the electro-optical device 1 according to variation 5 can control the capacity value Cdt of the retention capacitor 50 based on the brightness information Br.

For example, in the case where the driving control circuit 5 sets the potential Vref to a high potential based on the brightness information Br, brightness of an entire screen to be displayed in the display portion 100 is high, for example. In the case where brightness of the entire screen to be displayed in the display portion 100 is high, even if crosstalk, unevenness or the like occurs due to a potential fluctuation of the data line 14, this occurrence is unlikely to be visually recognized by a user of the electro-optical device 1. Accordingly, in this case, by making the capacity value Cdt smaller while making the capacitance ratios k1 and k2 larger (that is, making the compression ratio smaller), the display portion 100 can display a bright image and also a clear image in a larger contrast ratio.

In the example indicated in FIG. 21, the transistors 502 and 503 function as the first unit switch that is electrically connected in series with the retention capacitor 501 between the data line 14 and the power line 16.

In the example of FIG. 21, although each of the unit circuits Ud includes the transistors 502 and 503, the unit circuit Ud may include one of them. In this case, one of the two transistors 502, 503 functions as the first switch.

Variation 6

In the above embodiments and variations, although the retention capacitor 44 is formed with a single capacitive element, it can be formed with a plurality of capacitive elements like the retention capacitor 50 of variation 5. In this case, it is preferable for the driving control circuit 5 to control to select part of or all of the plurality of capacitive elements based on the brightness information Br, and electrically connect the selected capacitive elements to the nodes h1 and h2.

Figure 22:
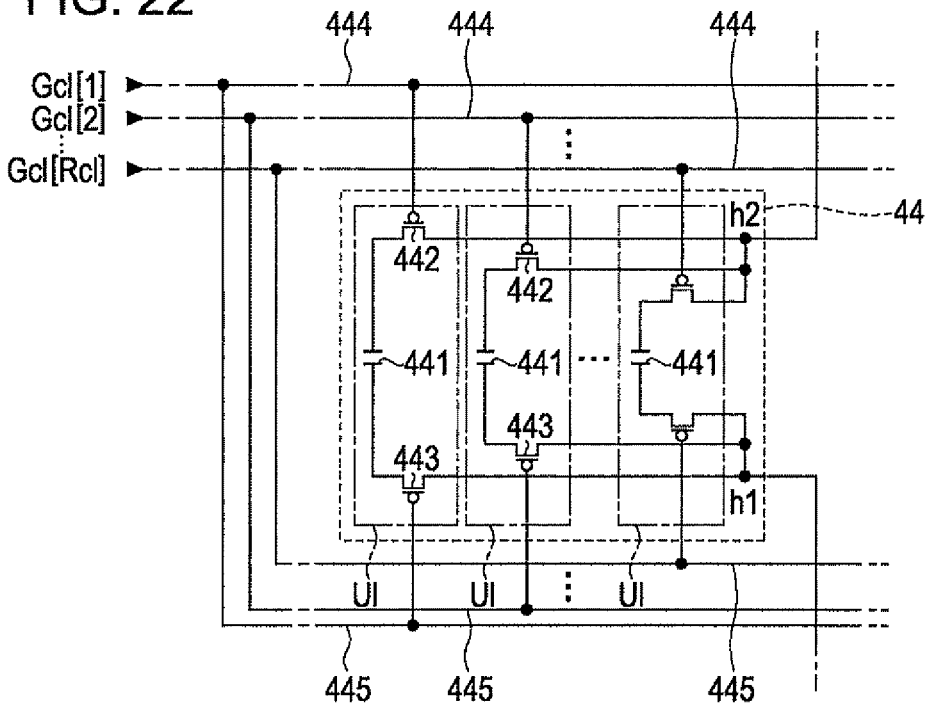
FIG. 22 is a diagram illustrating the configuration of a retention capacitor of variation 6.

FIG. 22 is a circuit diagram illustrating the configuration of the retention capacitor 44 according to variation 6. The retention capacitor 44 of variation 6 includes unit circuits U1 (third unit circuits) of a predetermined number Rc1 electrically connected in parallel between the node h1 and the node h2, where Rc1 is a natural number equal to or greater than 2.

Each of the unit circuits U1 includes a retention capacitor 441 (third unit capacitor) and transistors 442 and 443 electrically connected in series between the nodes h1 and h2. To be more specific, each of the unit circuits U1 includes the retention capacitor 441, the transistor 442 electrically connected between one end of the retention capacitor 441 and the node h2, and the transistor 443 electrically connected between the other end of the retention capacitor 441 and the node h1.

All of capacity values of the retention capacitors 441 of the predetermine number Rc1 may be the same, or they may differ from each other.

In the display panel 2 according to variation 6, control lines 444 of the predetermined number Rc1 and control lines 445 of the predetermined number Rc1 are provided so as to correspond to the unit circuits U1 of the predetermined number Rc1 in a one-to-one correspondence manner. The gate of the transistor 442 is electrically connected with the control line 444 corresponding to the unit circuit U1, and the gate of the transistor 443 is electrically connected with the control line 445 corresponding to the unit circuit U1.

Further, the driving control circuit 5 according to variation 6 generates, based on the brightness information Br, control signals Gc1 (1), Gc1 (2), . . . , Gc1 (Rc1), and supplies each of these control signals Gc1 of the predetermined number Rc1 to each of the control lines 444 of the predetermined number Rc1 and each of the control lines 445 of the predetermined number Rc1. Through this, the driving control circuit 5 can select, based on the brightness information Br, part of or all of the retention capacitors 441 from among the retention capacitor 441 of the predetermined number Rc1 and electrically connect the selected retention capacitors 441 to the node h1 and the node h2. In other words, the electro-optical device 1 according to variation 6 can control the capacity value Crf1 of the retention capacitor 44 based on the brightness information Br. With this, the capacitance ratios k1 and k2 can be controlled, thereby making it possible to control the compression ratio of the potential range ΔVgate of the gate node g, brightness of an image, the contrast ratio and so on to be displayed in the display portion 100.

Note that the transistors 442 and 443 function as the third unit switch that is electrically connected in series with the retention capacitor 441. The unit circuit U1 may have either one of the two transistors 442 and 443. In this case, either the transistors 442 or the transistor 443 functions as the third unit switch.

Variation 7

In the above embodiments and variations, although the retention capacitor 41 is formed with a single capacitive element, it can be formed with a plurality of capacitive elements like the retention capacitor 50 of variation 5. In this case, it is preferable for the driving control circuit 5 to control to select part of or all of the plurality of capacitive elements based on the brightness information Br, and electrically connect the selected capacitive elements to the nodes h3 and h4.

Figure 23:
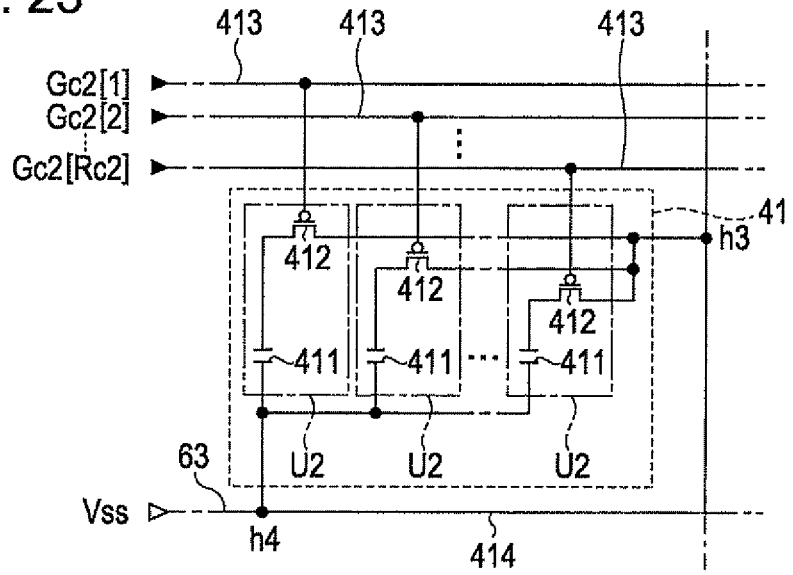
FIG. 23 is a diagram illustrating the configuration of a retention capacitor of variation 7.

FIG. 23 is a circuit diagram illustrating the configuration of the retention capacitor of variation 7. The retention capacitor 41 of variation 7 includes unit circuits U2 (fourth unit circuits) of a predetermined number Rc2 that are electrically connected in parallel between the node h3 and the node h4, where Rc2 is a natural number equal to or greater than 2.

Each of the unit circuits U2 includes a retention capacitor 411 (fourth unit capacitor) and a transistors 412 electrically connected in series between the nodes h3 and h4. To be more specific, each of the unit circuits U2 includes the retention capacitor 411 and the transistor 412 electrically connected between one end of the retention capacitor 411 and the node h3 (or node h4). All of capacity values of the retention capacitors 441 of the predetermine number Rc2 may be the same, or they may differ from each other. In the display panel 2 according to variation 6, control lines 413 of the predetermined number Rc2 are provided so as to correspond to the unit circuits U2 of the predetermined number Rc2 in a one-to-one correspondence manner. The gate of the transistor 412 is electrically connected with the corresponding control line 413.

Further, the driving control circuit 5 according to variation 7 generates, based on the brightness information Br, control signals Gc2 (1), Gc2 (2), . . . , Gc2 (Rc2), and supplies each of these control signals Gc2 of the predetermined number Rc2 to each of the control lines 413 of the predetermined number Rc2. Through this, the driving control circuit 5 can select, based on the brightness information Br, part of or all of the retention capacitors 411 from among the retention capacitor 411 of the predetermined number Rc2 and electrically connect the selected retention capacitors 411 to the nodes h3 and h4. In other words, the electro-optical device 1 according to variation 7 can control the capacity value Crf2 of the retention capacitor 41 based on the brightness information Br. Through this, it is possible to control the capacitance ratio k2, thereby making it possible to control the compression ratio of the potential range ΔVgate of the gate node g, brightness of an image, the contrast ratio and the like to be displayed in the display portion 100.

Note that the transistor 412 functions as the fourth unit switch connected in series with the retention capacitor 411. Further, the transistor 412 may be provided between the retention capacitor 411 and the node h4. In addition, the unit circuit U2 may have two transistors. In this case, those two transistors function as the fourth switch.

Variation 8

In the above embodiments and variations, although the display control circuit 4 generates the image signal Vid based on the image data Video and the brightness information Br, it may generate the image signal Vid only based on the image data Video. In this case, the storage unit 6 may include only one lookup table LUT in which the potential indicated by the image signal Vid and the luminance of the light emitting element are associated and stored.

Variation 9

In the above embodiments and variations, the OLED which is an light emitting element is cited as an example of an electro-optical element. Elements, such as an inorganic light emitting diode and a light emitting diode (LED), that emit light with the luminance in accordance with the quantity of an electric current may be included.

Application Examples

Electronic apparatuses in which the electro-optical device 1 according to the embodiments or application examples is applied will be described hereinafter. The electro-optical device 1 is suited for displaying an image with a small pixel size and with high precision. Therefore, a head-mounted display is cited as an example of an electronic apparatus and explained.

Figure 25:
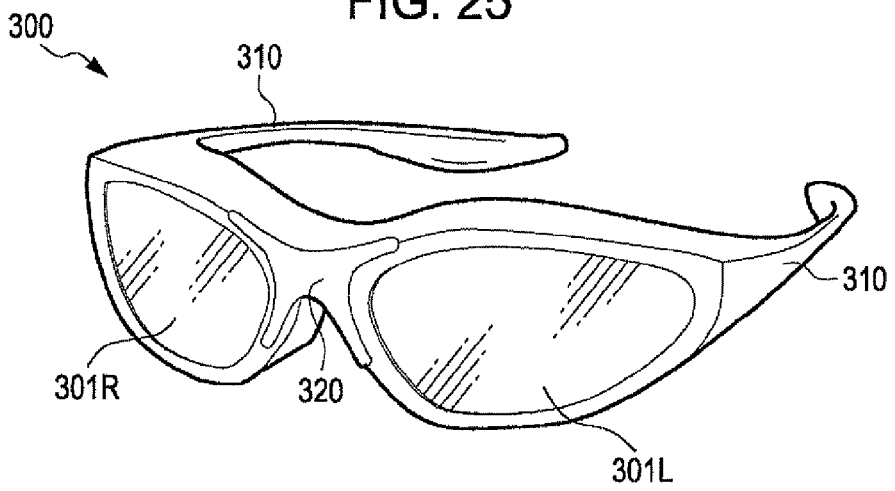
Figure 26:
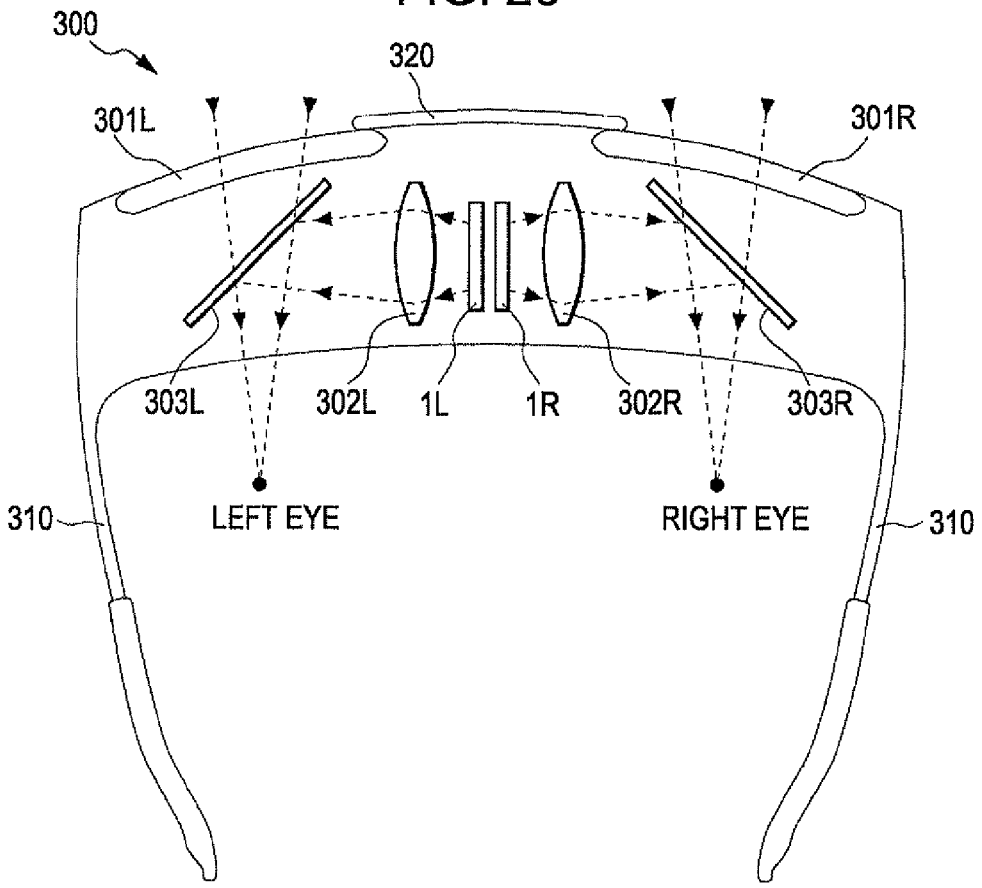
FIG. 26 is a diagram illustrating the optical configuration of the HMD.

FIG. 25 is a perspective view of a head-mounted display (HMD), and FIG. 26 is a diagram illustrating the optical configuration of the HMD.

As shown in FIG. 25, like typical glasses, a head-mounted display 300 includes, when viewed from exterior, a temple 310, a bridge 320, a lens 301L, and a lens 301R. Further, as shown in FIG. 26, in the head-mounted display 300, an electro-optical device for the left eye 1L and an electro-optical device for the right eye 1R are provided at positions in the vicinity of the bridge 320 and on the deep side (lower side in the drawing) from the lens 301L and the lens 301R, respectively.

An image-display face of the electro-optical device 1L is disposed to be on the left side in FIG. 26. With this, a display image outputted by the electro-optical device 1L is emitted to the direction of 9 o'clock in the drawing via an optical lens 302L. A half mirror 303L reflects the display image outputted by the electro-optical device 1L to the direction of 6 o'clock and passes light entering from the direction of 12 o'clock.

An image-display face of the electro-optical device 1R is disposed to be on the right side, which is opposite to the electro-optical device 1L side. With this, a display image outputted by the electro-optical device 1R is emitted to the direction of 3 o'clock in the drawing via an optical lens 302R. A half mirror 303R reflects the display image outputted by the electro-optical device 1R to the direction of 6 o'clock and passes light entering from the direction of 12 o'clock.

With this configuration, a person wearing the head-mounted display 300 can observe display images outputted by the electro-optical devices 1L and 1R while overlapping the display images and the outside view in a so called see-through manner.

Moreover, with this head-mounted display 300, of a binocular image with parallax, an image for the left eye is displayed by the electro-optical device 1L and an image for the right eye is displayed by the electro-optical device 1R, Accordingly, the person wearing the head-mounted display 300 can feel and see the displayed image as if the image has a deep side or is a 3-dimensional image.

It is to be noted that the electro-optical device 1 can be also applied to, in addition to the head-mounted display 300, electronic view finders of video cameras, digital cameras with interchangeable lenses, or the like.

What is claimed is:

1. An electro-optical device comprising:

a plurality of scanning lines;

a plurality of data lines;

a display portion equipped with a plurality of pixel circuits that are provided at positions corresponding to intersections of the plurality of scanning lines and the plurality of data lines;

a plurality of first retention capacitors, each of the plurality of first retention capacitors retaining potential of one of the plurality of data lines;

a data line driving circuit electrically connected with the plurality of data lines;

a driving control circuit that controls operation of the data line driving circuit; and a display control circuit that supplies brightness information, which indicates brightness of an entire screen to be displayed in the display portion, to the driving control circuit, each of the plurality of pixel circuits including:

a light emitting element;

a driving transistor supplying electric current to the light emitting element;

a write transistor electrically connected between the gate of the driving transistor and one data line among the plurality of data lines; and a second retention capacitor with a first end and a second end, the first end of the second retention capacitor is electrically connected with the gate of the driving transistor to retain voltage between the gate and the source of the driving transistor, the display control circuit supplying an image signal that specifies luminance of the light emitting element to the data line driving circuit, the data line driving circuit including:

a potential control line to which a potential control signal is supplied from the driving control circuit; and a level shift circuit, the level shift circuit including:

a third retention capacitor with a first end and a second end, the first end of the third retention capacitor is connected with the above one data line and the second end of the third retention capacitor is supplied with a potential based on the image signal; and a first transistor electrically connected between the second end of the third retention capacitor and the potential control line, and wherein the driving control circuit sets the potential control signal to a first potential when the brightness information is a first value and sets the potential control signal to a second potential when the brightness information is a second value.

2. The electro-optical device according to claim 1, the display control circuit including a storage unit in which luminance of the light emitting element, the potential indicated by the image signal and the brightness information are associated with each other and stored, and generating the image signal that specifies the luminance of the light emitting element based on the brightness information.

3. The electro-optical device according to claim 2, further comprising:

a scanning line driving circuit that controls operations of the plurality of pixel circuits, the data line driving circuit including a first power line that supplies an initial potential, the level shift circuit including a second transistor that is electrically connected between the first end of the third retention capacitor and the first power line, the driving control circuit keeping the second transistor in an ON-state during a first period, during a second period which starts after the first period ends, the scanning line driving circuit keeping the write transistor in the ON-state, and the driving control circuit keeping the first transistor in the ON-state while keeping the second transistor in an OFF-state, during a third period which starts after the second period ends, the scanning line driving circuit keeps the write transistor in the ON-state and the driving control circuit keeps the first transistor and the second transistor in the OFF-state, and potential based on the image signal being supplied to the second end of the third retention capacitor.

4. The electro-optical device according to claim 3, the level shift circuit includes a fourth retention capacitor with a first end and a second end, the first end of the fourth retention capacitor being provided with a potential based on the image signal which is outputted by the display control circuit during at least a part of a period from the start of the first period to the start of the third period, and the first end of the fourth retention capacitor being electrically connected with the second end of the third retention capacitor.

5. The electro-optical device according to claim 4, the data line driving circuit including a first switch and a second switch that are provided corresponding to the fourth retention capacitor, an output terminal of the first switch being electrically connected with the second end of the third retention capacitor, an input terminal of the first switch being electrically connected with the first end of the fourth retention capacitor and an output terminal of the second switch, during a time period from the start of the first period to the start of the third period, the driving control circuit turning the second switch into the ON-state while keeping the first switch in the OFF-state, the display control circuit supplying a potential based on the image signal to an input terminal of the second switch, and during the third period, the driving control circuit turning the first switch into the ON-state while keeping the second switch in the OFF-state.

6. The electro-optical device according to claim 5, the fourth retention capacitor including a plurality of fourth unit circuits that are electrically connected in parallel between a second power line supplied with a fixed potential and the output terminal of the second switch, each of the plurality of fourth unit circuits including a fourth unit capacitor and a fourth unit switch that are electrically connected in series between the second power line and the output terminal of the second switch, and the driving control circuit selectively turning part of or all of the plurality of fourth unit switches into the ON-state based on the brightness information.

7. The electro-optical device according to claim 5, the plurality of data lines being grouped for every predetermined number of the data lines, the driving circuit including each predetermined number of the third retention capacitors, fourth retention capacitors, first switches and second switches corresponding to the above predetermined number of the data lines, the input terminals of the predetermined number of the second switches being connected in the form of common connection, and the driving control circuit turning the predetermined number of the second switches into an ON-state in a predetermined order in synchronization with the supplied image signal during a time period from the start of the first period to the start of the third period.

8. The electro-optical device according to claim 7, the driving control circuit turning the predetermined number of the first switches to the ON-state simultaneously during the third period.

9. The electro-optical device according to claim 3, the pixel circuit including a threshold compensation transistor that is electrically connected between the gate and the drain of the driving transistor, and the scanning line driving circuit keeping the threshold compensation transistor in the ON-state during the second period and keeping the threshold compensation transistor in the OFF-state during the periods other than the second period.

10. The electro-optical device according to claim 3, further comprising a second power line that supplies a predetermined reset potential and that is provided corresponding to the one date line, the pixel circuit including an initializing transistor electrically connected between the second power line and the light emitting element, and the scanning line driving circuit keeping the initializing transistor in the ON-state during at least a part of the first through third periods.

11. In the electro-optical device according to claim 10, the second power line being provided along the one data line, the one data line and the second power line being disposed neighboring to each other, and the first retention capacitor being formed by the above one data line and the second power line.

12. The electro-optical device according to claim 10, the first retention capacitor including a plurality of first unit circuits that are electrically connected in parallel between the one data line and the second power line, each of the plurality of first unit circuits including a first unit capacitor and a first unit switch that are electrically connected in series between the above one data line and the second power line, and the driving control circuit selectively turning part of or all of the plurality of first unit switches into the ON-state based on the brightness information.

13. The electro-optical device according to claim 3, the pixel circuit including a light emission control transistor that is electrically connected between the driving transistor and the light emitting element, and the scanning line driving circuit keeping the light emission control transistor in the OFF-state during at least a time period from the start of the first period to the end of the third period.

14. The electro-optical device according to claim 1, the third retention capacitor including a plurality of third unit circuits that are electrically connected in parallel, each of the plurality of third unit circuits including a third unit capacitor and a third unit switch that are electrically connected in series with the data line, and the driving control circuit selectively turning part of or all of the plurality of third unit switches into the ON-state based on the brightness information.

15. An electronic apparatus comprising:

a plurality of scanning lines;

a plurality of data lines;

a display portion equipped with a plurality of pixel circuits that are provided at positions corresponding to intersections of the plurality of scanning lines and the plurality of data lines;

a plurality of first retention capacitors, each of the plurality of first retention capacitors retaining potential of one of the plurality of data lines;

a data line driving circuit electrically connected with the plurality of data lines;

a driving control circuit that controls operation of the data line driving circuit; and a display control circuit that supplies brightness information, which indicates brightness of an entire screen to be displayed in the display portion, to the driving control circuit, each of the plurality of pixel circuits including:

a light emitting element;

a driving transistor supplying electric current to the light emitting element;

a write transistor electrically connected between the gate of the driving transistor and one data line among the plurality of data lines; and a second retention capacitor with a first end and a second end, the first end of the second retention capacitor is electrically connected with the gate of the driving transistor to retain voltage between the gate and the source of the driving transistor, the display control circuit supplying an image signal that specifies luminance of the light emitting element to the data line driving circuit, the data line driving circuit including:

a potential control line to which a potential control signal is supplied from the driving control circuit; and a level shift circuit, the level shift circuit including:

a third retention capacitor with a first end and a second end, the first end of the third retention capacitor is connected with the above one data line and the second end of the third retention capacitor is supplied with a potential based on the image signal; and a first transistor electrically connected between the second end of the third capacitor and the potential control line, and wherein the driving control circuit sets the potential control signal to a first potential when the brightness information is a first value and sets the potential control signal to a second potential when the brightness information is a second value.

16. An electro-optical device comprising:

a plurality of scanning lines;

a plurality of data lines;

a display portion equipped with a plurality of pixel circuits that are provided at positions corresponding to intersections of the plurality of scanning lines and the plurality of data lines;

a plurality of first retention capacitors, each of the plurality of first retention capacitors retaining potential of one of the plurality of data lines;

a second retention capacitor provided in each of the plurality of pixel circuits;

a third retention capacitor with a first end and a second end, the first end of the third retention capacitor is connected with the above one data line and the second end of the third retention capacitor is supplied with a potential based on an image signal;

a data line driving circuit electrically connected with the plurality of data lines;

a driving control circuit that controls operation of the data line driving circuit and supplies a potential control signal;

a display control circuit that supplies brightness information, which indicates brightness of an entire screen to be displayed in the display portion, to the driving control circuit;

the display control circuit supplying the image signal that specifies luminance of the light emitting element to the data line driving circuit; and wherein the driving control circuit sets the potential control signal to a first potential when the brightness information is a first value and sets the potential control signal to a second potential when the brightness information is a second value.

17. A method of displaying a high-quality image on an electro-optical device having a first retention capacitor, a date line driving circuit, a driving control unit, a display control unit, a display portion equipped with a plurality of pixel circuits that are provided at positions corresponding to intersections of a plurality of scanning lines and a plurality of data lines, the plurality of pixel circuits being provided with a second retention capacitor, and a third retention capacitor with a first end and a second end, the first end of the third retention capacitor is connected with one data line among the plurality of data lines and the second end of the third retention capacitor is supplied with a potential based on an image signal, the method comprising:

retaining a potential of each of the plurality of data lines in the first retention capacitor;

electrically connecting with the plurality of data lines the data line driving circuit;

controlling operation of the data line driving circuit and supplying a potential control signal with the driving control circuit;

supplying brightness information using the display control circuit, which indicates brightness of an entire screen to be displayed in the display portion, to the driving control circuit;

supplying the image signal that specifies luminance of the light emitting element to the data line driving circuit using the display control circuit; and setting the potential control signal to a first potential when the brightness information is a first value and setting the potential control signal to a second potential when the brightness information is a second value.

* * * * *